US006873802B2

(12) United States Patent
Koga et al.

(10) Patent No.: US 6,873,802 B2
(45) Date of Patent: Mar. 29, 2005

(54) METHODS OF VERIFYING REQUIREMENT FOR REPLACEMENT OF A MAIN UNIT AND OF A COMPONENT OF IMAGE FORMATION APPARATUS AND JUDGING ADVISABILITY OF RECOMMENDATION FOR REPLACEMENT

(75) Inventors: Yoshiro Koga, Nagano-ken (JP); Ken Ikuma, Nagano-ken (JP); Ken Yoshizuka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/462,816

(22) Filed: Jun. 17, 2003

(65) Prior Publication Data

US 2004/0126123 A1 Jul. 1, 2004

(30) Foreign Application Priority Data

| | | |
|---|---|---|
| Jun. 17, 2002 | (JP) | 2002-176214 |
| Jun. 17, 2002 | (JP) | 2002-176215 |
| Jun. 17, 2002 | (JP) | 2002-176216 |
| Jun. 12, 2003 | (JP) | 2003-168181 |
| Jun. 12, 2003 | (JP) | 2003-168182 |
| Jun. 12, 2003 | (JP) | 2003-168183 |

(51) Int. Cl.[7] ..... G03G 15/08; G03G 15/00; G03G 15/02

(52) U.S. Cl. ..... 399/27; 399/31

(58) Field of Search ..... 399/24, 27, 31

(56) References Cited

U.S. PATENT DOCUMENTS 5,950,038 A * 9/1999 Okui ..... 399/43
6,490,422 B2 * 12/2002 Harumoto ..... 399/27

FOREIGN PATENT DOCUMENTS

JP 2003255783 A * 9/2003 ..... G03G/21/00

* cited by examiner

*Primary Examiner*—Quana Grainger
(74) *Attorney, Agent, or Firm*—Sughrue Mion, PLLC

(57) ABSTRACT

The technique of the present invention reads information, such as a use start date of a color laser printer, a cartridge detachment date, a total number of cartridges, used, a total consumption of toners, a total number of prints, and temperatures and humidities at an installation location, from a storage element of a toner cartridge, which has been attached to and detached from the color laser printer. When either the temperature or the humidity at the installation location is out of its normal service range, the technique modifies conditional values and determines whether immediate replacement of the main unit or each component of the color laser printer is required. When it is determined that immediate replacement is not required, the technique estimates a replacement timing of the main unit or the component, based on the above pieces of information.

49 Claims, 18 Drawing Sheets

FIG. 5

| |
|---|
| (Cartridge-Related Information) |
| Cartridge ID |
| Toner Color |
| Printer ID |
| Cartridge Attachment Date |
| Cartridge Detachment Date |
| Number of Prints |
| Residual Quantity of Toner |
| Printer-Related Information |
| Use Start Date |
| Total Number of Cartridges Used |
| Total Consumption of Toners |
| Total Number of Prints |
| Temperatures at Installation Locatio (Lowest Temprature, Highest Temperature) |
| Humidities at Installation Location (Lowest Humidity, Highest Humidity) |

| |
|---|
| Printer ID |
| Printer Type |
| Customer ID |
| Customer Name |
| Customer Postal Address |
| Estimated Replacement Timing |

| Estimated Replacement Timing | | Type | Customer Name | Customer Address |
|---|---|---|---|---|
| January 2002 | 2 | PA−001 | XX Industries | ABC Building |
| | 5 | PA−020 | YY Trading Company | ———— |
| | 9 | PB−005 | ZZ Corporation | XYZ |
| | 14 | PB−100 | PP Industries | ZA Building |
| | 30 | PC−002 | QQ Co., Ltd. | OOO Building |
| February 2002 | 9 | PA−100 | XX Industries | ABC |
| | 13 | PB−002 | RR Trading Company | EFG |
| | 23 | PA−100 | AA Co., Ltd | LMN |
| | 25 | PB−002 | BB Industries | AAA Building |

FIG. 12

| |
|---|
| (Cartridge-Related Information) |
| Cartridge ID |
| Toner Color |
| Printer ID |
| Cartridge Attachment Date |
| Cartridge Detachament Date |
| Number of Prints |
| Residual Quantity of Toner |
| (Printer-Related Information) |
| (Exposure Unit) |
| Use Start Date |
| Total Number or Cartridges Used |
| Total Consumption of Toners |
| Total Number of Prints |
| Temperatures at Installation Location (Lowest Temperature, Highest Temerature) |
| Humidities at Installation Location (Lowest Humidity, Highest Humidity) |
| (Photoreceptor) |
| Use Start Date |
| Total Number or Cartridges Used |
| Total Consumption of Toners |
| Total Number of Prints |
| Temperatures at Installation Location (Lowest Temperature, Highest Temerature) |
| Humidities at Installation Location (Lowest Humidity, Highest Humidity) |
| (Transfer Belt) |
| Use Start Date |
| Total Number or Cartridges Used |
| Total Consumption of Toners |
| Total Number of Prints |
| Temperatures at Installation Location (Lowest Temperature, Highest Temerature) |
| Humidities at Installation Location (Lowest Humidity, Highest Humidity) |

| |
|---|
| Printer ID |
| Printer Type |
| Customer ID |
| Customer Name |
| Customer Postal Address |
| Estimated Replacement Timing (Exposure Unit) |
| Estimated Replacement Timing (Photoreceptor) |
| Estimated Replacement Timing (Transfer Belt) |

FIG. 16

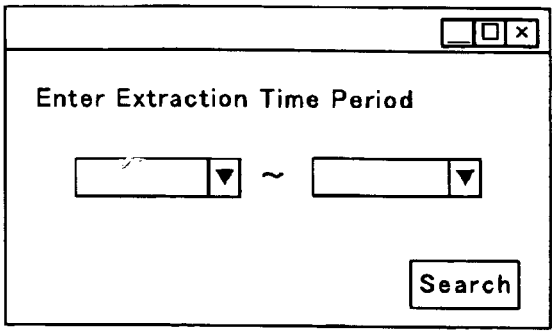

FIG. 17

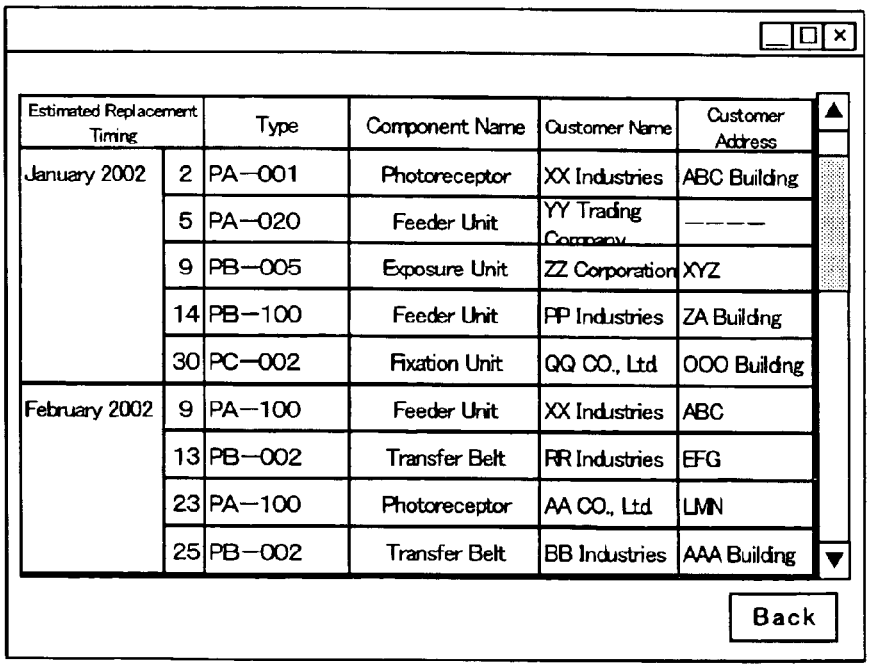

| Estimated Replacement Timing | | Type | Component Name | Customer Name | Customer Address |
|---|---|---|---|---|---|
| January 2002 | 2 | PA—001 | Photoreceptor | XX Industries | ABC Building |
| | 5 | PA—020 | Feeder Unit | YY Trading Company | ———— |
| | 9 | PB—005 | Exposure Unit | ZZ Corporation | XYZ |
| | 14 | PB—100 | Feeder Unit | PP Industries | ZA Building |
| | 30 | PC—002 | Fixation Unit | QQ CO., Ltd | OOO Building |
| February 2002 | 9 | PA—100 | Feeder Unit | XX Industries | ABC |
| | 13 | PB—002 | Transfer Belt | RR Industries | EFG |
| | 23 | PA—100 | Photoreceptor | AA CO., Ltd | LMN |
| | 25 | PB—002 | Transfer Belt | BB Industries | AAA Building |

Back

FIG. 19

| (Information on Use of Cartridge) |
| --- |
| Cartiridge ID |
| Toner Color |
| Printer ID |
| Cartridge Attachment Date |
| Cartridge Detachment Date |
| Number of Prints |
| Residual Quantity of Toner |
| (Information on Cumulative Use of Printer) |
| Use Start Date |
| Replacement Record of Cartridges |
| Monthly Average Number of Prints |
| Total Consumption of Respective Color Toners (C, M, Y, K) |

| Printer Product Information |
| --- |
| Product Name |
| Printing Speed |
| Paper Feed Amount |
| Adequate Color Mode (Color/Monochromatic) |
| Warm-up Time |
| Weight |
| Power Consumption |

METHODS OF VERIFYING REQUIREMENT FOR REPLACEMENT OF A MAIN UNIT AND OF A COMPONENT OF IMAGE FORMATION APPARATUS AND JUDGING ADVISABILITY OF RECOMMENDATION FOR REPLACEMENT

BACKGROUND OF THE INVENTION

1. Field of the Invention

The present invention relates to methods of verifying requirement for replacement of a main unit and of a component of an image formation apparatus, a method of estimating a replacement timing, and corresponding replacement verification devices, a device of specifying an advisable recommendation for replacement of the image formation apparatus, a corresponding recommendation specification method, programs for attaining such methods, and a toner cartridge.

2. Description of the Prior Art

Verification of requirement for replacement of the main unit of each image formation apparatus like a color laser printer or a photocopier is conventionally based on the useful life of the apparatus. For example, the conventional method verifies the requirement for replacement of an apparatus when the use period of the apparatus reaches the end of life. In the event of the occurrence of any failure or trouble, the failed apparatus is inspected and replaced according to the requirements, irrespective of the useful life.

The useful life of each apparatus is determined uniformly as the basis of depreciation. The requirement for replacement of the main unit of the image formation apparatus verified by the conventional method may accordingly be different from the actual replacement timing. The replacement timing is varied according to the usage, the frequency of use, and the life cycle of the product. The setting of the replacement timing may thus be too early and force a non-required replacement of the apparatus. The setting of the replacement timing may otherwise be too late and cause a trouble or failure of the apparatus. One applicable measure replaces the apparatus after the occurrence of any failure or trouble. This method can not, however, make necessary preparations for the replacement. It accordingly wastes time before replacement and the user may suffer a loss.

The verification of requirement for replacement of a component included in each image formation apparatus like a color laser printer or a photocopier is typically based on the occurrence of any failure or trouble. In the event of the occurrence of any failure or trouble, the failed apparatus is inspected and fixed, and faulty components are replaced according to the requirements.

This conventional method, however, does not verify the requirement for replacement of each component of the image formation apparatus until a trouble or failure actually arises. It is thus practically impossible to make necessary preparations for such replacement, for example, arrangement of a required worker and replacement components. It accordingly takes time before replacement. The user can not use the apparatus for a while and may suffer a significant loss.

The image formation apparatuses like color laser printers and photocopiers have products of diverse specifications according to various applications. In the case of installation of such an image formation apparatus, the conventional method assumes a working state at an installation location, estimates a required specification, and specifies an advisable recommendation of the apparatus to be installed. The installed apparatus is typically replaced by an apparatus of an equivalent specification, unless any obvious trouble or problem arises.

There are, however, difficulties in accurately estimating the actual working state, and the estimated working state may be different from the actual working state. This causes the image formation apparatus specified as the advisable recommendation to be inadequate for the actual working state. Even when the image formation apparatus specified as the advisable recommendation was adequate at the time of its installation, a subsequent variation in working state may cause the specification of the advisable recommendation to be inadequate. Replacement of the image formation apparatus with an apparatus of an equivalent specification may accordingly result in successive use of apparatuses of inadequate specifications. The replaced apparatus is thus to be replaced again at an earlier timing than expected.

SUMMARY OF THE INVENTION

A replacement verification method for an image formation apparatus and a corresponding replacement verification device of the present invention are designed to adequately verify requirement for replacement of the image formation apparatus. A replacement timing estimation method for an image formation apparatus of the present invention is designed to adequately estimate a replacement timing of the image formation apparatus. A program of the present invention intends to make a computer execute the respective steps of the replacement verification method to adequately verify requirement for replacement of the image formation apparatus or the respective steps of the replacement timing estimation method to adequately estimate the replacement timing of the image formation apparatus. A toner cartridge of the invention is useful for verification of requirement for replacement of the image formation apparatus, as well as for estimation of the replacement timing of the image formation apparatus.

A component replacement verification method for an image formation apparatus and a corresponding component replacement verification device of the present invention are designed to adequately verify requirement for replacement of each component of the image formation apparatus. A component replacement timing estimation method for an image formation apparatus of the present invention is designed to adequately estimate a replacement timing of each component of the image formation apparatus. A program of the present invention used for the component replacement verification method intends to make a computer function as a device for adequately verifying requirement for replacement of each component of the image formation apparatus. A program of the present invention used for the component replacement timing estimation method intends to make a computer function as a device for adequately estimating a replacement timing of each component of the image formation apparatus. A toner cartridge of the invention is useful for verification of requirement for replacement of each component of the image formation apparatus, as well as for estimation of the replacement timing of each component of the image formation apparatus.

A recommendation specification method for an image formation apparatus and a corresponding recommendation specification device of the invention are designed to adequately specify an advisable recommendation for replacement of the image formation apparatus. The recommendation specification method for the image formation apparatus and the corresponding recommendation specification device of the invention are also designed to readily specify an advisable recommendation for replacement of the image formation apparatus. Programs of the invention used for the recommendation specification method and the corresponding recommendation specification device intend to make a computer function as a device for readily and adequately specifying an advisable recommendation for replacement of the image formation apparatus.

In order to achieve at least a part of the aforementioned objects, methods of verifying requirement for replacement of a main unit and of a component of an image formation apparatus, a method of estimating a replacement timing, and corresponding replacement verification devices, a device of specifying an advisable recommendation for replacement of the image formation apparatus, a corresponding recommendation specification method, programs for attaining such methods, and a toner cartridge of the present invention are structured as follows.

A first replacement verification method for an image formation apparatus of the invention include the steps of: (a) storing apparatus use-related information into the storage element of the toner cartridge attached to the image formation apparatus, where the apparatus use-related information includes a cumulative value regarding use of the image formation apparatus; (b) acquiring the apparatus use-related information from the storage element; and (c) verifying requirement for replacement of the image formation apparatus, when the cumulative value included in the acquired apparatus use-related information is not less than a preset value.

The first replacement verification method of the invention stores the apparatus use-related information, which includes the cumulative value regarding the use of the image formation apparatus, into the storage element of the toner cartridge attached to the image formation apparatus, acquires the apparatus use-related information from the storage element, and verifies requirement for replacement of the image formation apparatus when the cumulative value included in the acquired apparatus use-related information is not less than a preset value. This arrangement ensures adequate verification of the requirement for replacement of the image formation apparatus on the basis of the cumulative value regarding the use of the image formation apparatus. Here, the cumulative value represents a cumulative number of toner cartridges, which have been attached to the image formation apparatus for use, a cumulative consumption of toners, which have been consumed in the image formation apparatus, and a cumulative number of image-forming prints, which have been printed by the image formation apparatus.

In the first replacement verification method of the invention, the step (a) stores the apparatus use-related information, which includes a use start time of the image formation apparatus, in addition to the cumulative value, and the replacement verification method further include the step of: (d) estimating a timing when the cumulative value reaches the preset value as a replacement timing of the image formation apparatus, based on the acquired apparatus use-related information, in the case of verification of no requirement for replacement of the image formation apparatus at the step (c). Moreover, in the first replacement verification method of the invention, the step (a) stores at least one of a working environmental temperature and a working environmental humidity of the image formation apparatus as working environment information, in addition to the apparatus use-related information, and the step (c) modifies the preset value based on the working environment information to verify the requirement for replacement of the image formation apparatus. Further, in the replacement verification method of the invention, the step (a) is executed by the image formation apparatus at a time of attachment of the toner cartridge to the image formation apparatus or at a time of detachment of the toner cartridge from the image formation apparatus.

A first storage medium of the present invention stores a program therein, and the program includes: (a) a module that acquires apparatus use-related information from a storage element of a toner cartridge, where the apparatus use-related information includes a cumulative value regarding use of the image formation apparatus, to which the toner cartridge had been attached; and (b) a module that verifies requirement for replacement of the image formation apparatus, when the cumulative value included in the acquired apparatus use-related information is not less than a preset value.

The first storage medium of the invention causes the program stored therein to be installed in and executed by a computer. The computer thus functions as a device of adequately verifying requirement for replacement of the image formation apparatus on the basis of the apparatus use-related information, which includes the cumulative value regarding the use of the image formation apparatus.

A first replacement timing estimation method for an image formation apparatus of the present invention is a method estimating a replacement timing of the image formation apparatus, which is used with a toner cartridge that is attached thereto and has a storage element, and the replacement timing estimation method includes the steps of: (a) storing apparatus use-related information into the storage element of the toner cartridge attached to the image formation apparatus, where the apparatus use-related information includes a cumulative value regarding use of the image formation apparatus and a use start date of the image formation apparatus; (b) acquiring the apparatus use-related information from the storage element; and (c) estimating a timing when the cumulative value reaches a preset value as the replacement timing of the image formation apparatus, based on the acquired apparatus use-related information.

The first replacement timing estimation method of the invention stores the apparatus use-related information, which includes the cumulative value regarding the use of the image formation apparatus and the use start date of the image formation apparatus, into the storage element of the toner cartridge attached to the image formation apparatus, acquires the apparatus use-related information from the storage element, and estimates a timing when the cumulative value included in the acquired apparatus use-related information reaches a preset value as the replacement timing of the image formation apparatus. This arrangement ensures adequate estimation of the replacement timing of the image formation apparatus on the basis of the cumulative value regarding the use of the image formation apparatus. Here, the cumulative value represents at least one of a cumulative number of toner cartridges, which have been attached to the image formation apparatus for use, a cumulative consumption of toners, which have been consumed in the image formation apparatus, and a cumulative number of image-forming prints, which have been printed by the image formation apparatus.

In the first replacement timing estimation method, there may be further provided with the step of: mapping apparatus identification information for identifying the image formation apparatus to customer information on a customer who owns the image formation apparatus and storing the mapped information, prior to the step (a), and the step (a) stores the apparatus identification information for identifying the image formation apparatus into the storage element, in addition to the apparatus use-related information; the step (b) acquires the apparatus identification information as well as the apparatus use-related information from the storage element and stores the acquired apparatus use-related information in relation to the customer information mapped to the acquired apparatus identification information; and the step (c) stores the estimated replacement timing in relation to the apparatus identification information, after estimation of the replacement timing. The first replacement timing estimation method further includes steps of: (d) when an extraction time period is set as an extraction condition, extracting the customer information and the apparatus identification information having the estimated replacement timing, which is stored in relation to the apparatus identification information, within the setting of the extraction time period; and (e) outputting information on the image formation apparatus, which is related to the extracted apparatus identification information, and the extracted customer information. Additionally, in the replacement timing estimation method of the invention, the step (a) stores at least one of a working environmental temperature and a working environmental humidity of the image formation apparatus as working environment information, in addition to the apparatus use-related information, and the step (c) modifies the preset value based on the working environment information to estimate the replacement timing of the image formation apparatus. Moreover, in the replacement timing estimation method, the step (a) is executed by the image formation apparatus at a time of attachment of the toner cartridge to the image formation apparatus or at a time of detachment of the toner cartridge from the image formation apparatus.

A second storage medium of the present invention stores a program therein, and the program includes: (a) a module that acquires apparatus use-related information from a storage element of a toner cartridge, where the apparatus use-related information includes a cumulative value regarding use of the image formation apparatus and a use start date of the image formation apparatus, to which the toner cartridge had been attached; and (b) a module that estimate a timing when the cumulative value reaches a preset value as the replacement timing of the image formation apparatus, based on the acquired apparatus use-related information.

The second storage medium of the invention causes the program stored therein to be installed in and executed by a computer. The computer thus functions as a device of adequately estimating the replacement timing of the image formation apparatus on the basis of the apparatus use-related information, which includes the cumulative value regarding the use of the image formation apparatus with the toner cartridge attached thereto and the use start time of the image formation apparatus.

A replacement verification device of the present invention verifies requirement for replacement of an image formation apparatus with a toner cartridge attached thereto, based on apparatus use-related information written in a storage element of the toner cartridge by the image formation apparatus, and the replacement verification device includes: an information acquisition module that acquires a cumulative value regarding use of the image formation apparatus as the apparatus use-related information from the storage element; and a replacement verification module that verifies requirement for replacement of the image formation apparatus, when the acquired cumulative value is not less than a preset value.

The replacement verification device of the invention acquires the cumulative value regarding the use of the image formation apparatus, which has been written by the image formation apparatus, as the apparatus use-related information from the storage element of the toner cartridge attached to the image formation apparatus, and verifies requirement for replacement of the image formation apparatus when the acquired cumulative value is not less than a preset value. Namely the replacement verification device of the invention verifies requirement for replacement of he image formation apparatus on the basis of the cumulative value regarding the use of the image formation apparatus. This arrangement ensures adequate verification of the requirement for replacement of the image formation apparatus.

A second replacement verification method for an image formation apparatus of the present invention is a method verifying requirement for replacement of an image formation apparatus, which is used with a toner cartridge that is attached thereto and has a storage element, and the replacement verification method includes the steps of: (a) storing use-related information regarding use of the image formation apparatus into the storage element of the toner cartridge attached to the image formation apparatus; (b) acquiring the use-related information from the storage element; and (c) verifying requirement for replacement of the image formation apparatus, based on the acquired use-related information.

The second replacement verification method of the invention stores the use-related information regarding the use of the image formation apparatus into the storage element of the toner cartridge attached to the image formation apparatus, acquires the use-related information from the storage element, and verifies requirement for replacement of the image formation apparatus based on the acquired use-related information. This arrangement ensures adequate verification of the requirement for replacement of the image formation apparatus.

A second replacement timing estimation method for an image formation apparatus of the present invention estimates a replacement timing of the image formation apparatus, which is used with a toner cartridge that is attached thereto and has a storage element, and the replacement timing estimation method includes the steps of: (a) storing use-related information regarding use of the image formation apparatus into the storage element of the toner cartridge attached to the image formation apparatus; (b) acquiring the use-related information from the storage element; and (c) estimating the replacement timing of the image formation apparatus, based on the acquired use-related information.

The second replacement timing estimation method of the invention stores the use-related information regarding the use of the image formation apparatus into the storage element of the toner cartridge attached to the image formation apparatus, acquires the use-related information from the storage element, and estimates the replacement timing of the image formation apparatus based on the acquired use-related information. This arrangement ensures adequate estimation of the replacement timing of the image formation apparatus.

A toner cartridge of the present invention includes: a storage element that stores at least one cumulative value among a cumulative number of toner cartridges, which have been attached to the image formation apparatus for use, a cumulative consumption of toners, which have been consumed in the image formation apparatus, and a cumulative number of image-forming prints, which have been printed by the image formation apparatus, as one piece of writing information by the image formation apparatus.

The toner cartridge of the invention stores the cumulative number of toner cartridges attached to and used by the image formation apparatus, the cumulative consumption of toners, and the cumulative number of image-forming prints. The storage contents, that is, the cumulative number of toner cartridges, the cumulative consumption of toners, and the cumulative number of image-forming prints, are effectively usable for verification of the requirement for replacement of the image formation apparatus, as well as for estimation of the replacement timing of the image formation apparatus.

In the toner cartridge constructed in this way, the storage element further stores at least one of a working environmental temperature and a working environmental humidity of the image formation apparatus as another piece of the writing information. Moreover, in the toner cartridge, the writing information is written by the image formation apparatus at a time of attachment of the toner cartridge to the image formation apparatus or a time of detachment of the toner cartridge from the image formation apparatus.

A component replacement verification method of the present invention verifies requirement for replacement of at least one component in an image formation apparatus, which is used with a toner cartridge that is attached thereto and has a storage element, and the component replacement verification method includes the steps of: (a) storing component use-related information regarding use of the at least one component into the storage element of the toner cartridge attached to the image formation apparatus; (b) acquiring the component use-related information from the storage element; and (c) verifying requirement for replacement of the at least one component, based on the acquired component use-related information.

The component replacement verification method of the invention stores the component use-related information regarding the use of a component of the image formation apparatus into the storage element of the toner cartridge attached to the image formation apparatus, acquires the component use-related information from the storage element, and verifies requirement for replacement of the component based on the acquired component use-related information. This arrangement ensures adequate verification of the requirement for replacement of the component. Here, the at least one component includes at last one of a photoreceptor, a charge unit, an exposure unit, a cleaning unit, a transfer unit, a fixation unit, and a paper feed unit.

In the component replacement verification method constructed in this way, the step (a) stores information including apparatus use-related information, which regards use of the image formation apparatus since attachment of the at least one component to the image formation apparatus, as the component use-related information. In this case, the step (a) stores at least one cumulative value among a cumulative number of toner cartridges, which have been attached to the image formation apparatus for use since attachment of the at least one component to the image formation apparatus, a cumulative consumption of toners, which have been consumed in the image formation apparatus, and a cumulative number of image-forming prints, which have been printed by the image formation, apparatus, as the apparatus use-related information, and the step (c) verifies requirement for replacement of the at least one component, when the cumulative value is not less than a preset value. Further, the step (a) stores at least one piece of working environmental information out of a working environmental temperature and a working environmental humidity of the image formation apparatus since attachment of the at least one component to the image formation apparatus, as the apparatus use-related information, and the step (c) modifies the preset value based on the at least one piece of working environmental information to verify requirement for replacement of the at least one component. Moreover, the step (a) stores the component use-related information, which includes a use start time of the at least one component, in addition to the cumulative value, and the component replacement verification method further includes the step of: (d) estimating a timing when the cumulative value reaches the preset value as a replacement timing of the at least one component, based on the acquired apparatus use-related information, in the case of verification of no requirement for replacement of the at least one component at the step (c). Additionally, in the component replacement verification method, the step (a) is executed by the image formation apparatus at a time of attachment of the toner cartridge to the image formation apparatus or at a time of detachment of the toner cartridge from the image formation apparatus.

A third storage medium of the present invention stores a program therein, and the program include: (a) a module that acquires component use-related information, which regards use of a component included in an image formation apparatus with a toner cartridge attached thereto, from a storage element of the toner cartridge; and (b) a module that verifies requirement for replacement of the component, based on the acquired component use-related information.

The third storage medium of the invention causes the program stored therein to be installed in and executed by a computer. The computer thus functions as a device of adequately verifying requirement for replacement of the component of the image formation apparatus on the basis of the component use-related information.

A component replacement timing estimation method of the present invention estimates a replacement timing of a component included in an image formation apparatus with a toner cartridge that is attached thereto and has a storage element, and the component replacement timing estimation method includes the steps of: (a) storing component use-related information regarding use of the component into the storage element of the toner cartridge attached to the image formation apparatus; (b) acquiring the component use-related information from the storage element; and (c) estimating the replacement timing of the component, based on the acquired component use-related information.

The component replacement timing estimation method of the invention stores the component use-related information regarding the use of a component of the image formation apparatus into the storage element of the toner cartridge attached to the image formation apparatus, acquires the component use-related information from the storage element, and estimates replacement timing of the component based on the acquired component use-related information. This arrangement ensures adequate estimation of the replacement timing of the component of the image formation apparatus. Here, the at least one component includes at last one of a photoreceptor, a charge unit, an exposure unit, a cleaning unit, a transfer unit, a fixation unit, and a paper feed unit.

In the component replacement timing estimation method constructed in this way, the step (a) stores information including apparatus use-related information regarding use of the image formation apparatus since attachment of the component to the image formation apparatus and a use start time of the component, as the component use-related information. In this case, the component replacement timing estimation method further includes the step of: mapping apparatus identification information for identifying the image formation apparatus to administrator information on an administrator of the image formation apparatus and storing the mapped information, prior to the step (a), and the step (a) stores the apparatus identification information for identifying the image formation apparatus into the storage element, in addition to the component use-related information; the step (b) acquires the apparatus identification information as well as the component use-related information from the storage element and stores the acquired component use-related information in relation to the administrator information mapped to the acquired apparatus identification information; and the step (c) stores the estimated replacement timing in relation to the apparatus identification information, after estimation of the replacement timing. The component replacement timing estimation method further includes the steps of: (d) when an extraction time period is set as an extraction condition, extracting the administrator information and the apparatus identification information having the estimated replacement timing, which is stored in relation to the apparatus identification information, within the setting of the extraction time period; and (e) outputting information on the component, which is related to the extracted apparatus identification information, and the extracted administrator information. In this case, the step (a) stores at least one cumulative value among a cumulative number of toner cartridges, which have been attached to the image formation apparatus for use since attachment of the component to the image formation apparatus, a cumulative consumption of toners, which have been consumed in the image formation apparatus, and a cumulative number of image-forming prints, which have been printed by the image formation apparatus, as the apparatus use-related information, and the step (c) estimates a timing when the cumulative value reaches the preset value as a replacement timing of the component. Additionally, the step (a) stores at least one of a working environmental temperature and a working environmental humidity of the image formation apparatus as working environmental information, in addition to the component use-related information, and the step (c) modifies the preset value based on the working environmental information to estimate the replacement timing of the component. Further, in the component replacement timing estimation method of the invention, the step (a) is executed by the image formation apparatus at a time of attachment of the toner cartridge to the image formation apparatus or at a time of detachment of the toner cartridge from the image formation apparatus.

A fourth storage medium of the present invention stores a program therein, and the program includes: (a) a module that acquires component use-related information, which regards use of a component included in an image formation apparatus with a toner cartridge attached thereto, from a storage element of the toner cartridge; and (b) a module that verifies requirement for replacement of the component, based on the acquired component use-related information.

The fourth storage medium of the invention causes the program stored therein to be installed in and executed by a computer. The computer thus functions as a device of adequately estimating the replacement timing of the component of the image formation apparatus on the basis of the component use-related information.

The component replacement verification device of the invention verifies requirement for replacement of at least one component included in an image formation apparatus, which is used with a toner cartridge that is attached thereto and has a storage element, and the component replacement verification device includes: an information acquisition module that acquires component use-related information regarding use of the at least one component from the storage element of the toner cartridge attached to the image formation apparatus; and a replacement verification module that verifies requirement for replacement of the at least one component, based on the acquired component use-related information.

The component replacement verification device of the invention acquires the component use-related information regarding the use of a component of the image formation apparatus from the storage element of the toner cartridge attached to the image formation apparatus, and verifies requirement for replacement of the component based on the acquired component use-related information. This arrangement ensures adequate verification of the requirement for replacement of the component of the image formation apparatus. Here the 'component use-related information' may include apparatus use-related information regarding the use of the image formation apparatus since attachment of the component to the image formation apparatus.

The recommendation specification method of the present invention specifies an advisable recommendation for replacement of an image formation apparatus, and the recommendation specification method includes the steps of: (a) storing information on multiple image formation apparatuses having different performances as apparatus information; (b) storing information, which includes use-related information regarding use of the image formation apparatus, into a storage element of a toner cartridge attached to the image formation apparatus; (c) acquiring the use-related information from the storage element; and (d) selecting a piece of apparatus information adequate for an installation location of the image formation apparatus out of the stored apparatus information, based on the acquired use-related information, and specifying an advisable image formation apparatus corresponding to the selected piece of apparatus information as the advisable recommendation.

The recommendation specification method of the invention stores the information on multiple image formation apparatuses having different performances as apparatus information, stores the information, which includes the use-related information regarding the use of the image formation apparatus, into the storage element of the toner cartridge attached to the image formation apparatus, and acquires the use-related information from the storage element. The recommendation specification method then selects a piece of apparatus information adequate for the installation location of the image formation apparatus out of the stored apparatus information, based on the acquired use-related information, and specifies an advisable image formation apparatus corresponding to the selected piece of apparatus information as the advisable recommendation. This arrangement ensures adequate and easy specification of the advisable recommendation by taking into account the actual working state of the image formation apparatus.

In the recommendation specification method of the invention, the step (d) includes the sub-steps of: (d1) setting a recommended performance of the image formation apparatus, based on the acquired use-related information; (d2) selecting a piece of apparatus information that satisfies the setting of the recommended performance out of the stored apparatus information; and (d3) specifying the advisable image formation apparatus corresponding to the selected piece of apparatus information as the advisable recommendation. In this case, the sub-step (d2) selects a piece of apparatus information representing a specific image formation apparatus having either a higher performance or a lower performance proximate to the setting of the recommended performance out of the stored apparatus information, and the sub-step (d1) sets a prospective recommended performance of the image formation apparatus after elapse of a predetermined time period since detachment of the toner cartridge from the image formation apparatus. Further, in the recommendation specification method of the invention, the step (d) selects the piece of apparatus information, based on use-related information for a predetermined time period prior to detachment of the toner cartridge from the image formation apparatus, among the acquired use-related information. Moreover, in the recommendation specification method of the invention, the use-related information includes a use period of each toner cartridge, which had been attached to the image formation apparatus, and the step (d) selects a piece of apparatus information representing an image formation apparatus of a higher image formation speed, in response to a shorter use period. Additionally, in the recommendation specification method of the invention, the use-related information includes a total consumption of toners, and the step (d) selects a piece of apparatus information representing an image formation apparatus with a larger capacity of a toner cartridge attachable thereto, in response to a greater total consumption of toners, and the use-related information includes an average number of image-forming prints per unit time, and the step (d) selects a piece of apparatus information representing an image formation apparatus with a greater volume of a paper cassette mountable thereon, in response to a higher average number of image-forming prints.

A fifth storage medium of the present invention stores a program therein, and the program includes: (a) a module that acquires use-related information, which regards use of an image formation apparatus with a toner cartridge attached thereto, from a storage element of the toner cartridge; and (b) a module that selects a piece of apparatus information, which is adequate for an installation location of the image formation apparatus based on the acquired use-related information, from a memory unit that stores information on multiple image formation apparatuses having different performances as apparatus information, and specifies an advisable image formation apparatus corresponding to the selected piece of apparatus information as an advisable recommendation.

The fifth storage medium of the invention causes the program stored therein to be installed in and executed by a computer. The computer thus functions as a recommendation specification device that specifies an advisable recommendation for replacement of the image formation apparatus on the basis of the use-related information of the image formation apparatus.

A recommendation specification device of the present invention specifies an advisable recommendation for replacement of an image formation apparatus, and the recommendation specification apparatus includes:an information memory unit that stores apparatus information on multiple image formation apparatuses having different performances as part of storable information and is capable of storing other information; a connection module that is electrically connectable with a storage element of a toner cartridge, which is attachable to and detachable from the image formation apparatus; a use-related information input control module that inputs from the storage element use-related information, which regards use of the image formation apparatus and has been written into the storage element by the image formation apparatus, under an electrical connection with the storage element by means of the connection module, and stores the input use-related information into the information memory unit; and an information selection control module that selects a piece of apparatus information adequate for an installation location of the image formation apparatus out of the apparatus information stored in the information memory unit, based on the use-related information stored in the information memory unit, and outputs the selected piece of apparatus information as information on the advisable recommendation.

The recommendation specification device of the invention inputs the use-related information, which regards the use of the image formation apparatus and has been written into the storage element of the toner cartridge by the image formation apparatus, under an electrical connection with the storage element by means of the connection module. The recommendation specification device selects a piece of image formation apparatus information (apparatus information) adequate for the installation location of the image formation apparatus based on the input use-related information, and outputs the selected piece of apparatus information as information on the advisable recommendation. This arrangement ensures easy and adequate specification of the advisable recommendation for replacement of the image formation apparatus.

BRIEF DESCRIPTION OF THE DRAWINGS

FIG. 5 shows one example of the information stored in the storage element 50 of the toner cartridge 40;

FIG. 12 shows one example of information written into the storage element 50 of the toner cartridge 40;

FIG. 16 shows one example of the extraction time period input window;

FIG. 17 shows one example of the replacement schedule output window;

FIG. 19 shows one example of information written into the storage element 50 of the toner cartridge 40;

DESCRIPTION OF THE PREFERRED EMBODIMENTS

Figure 1:
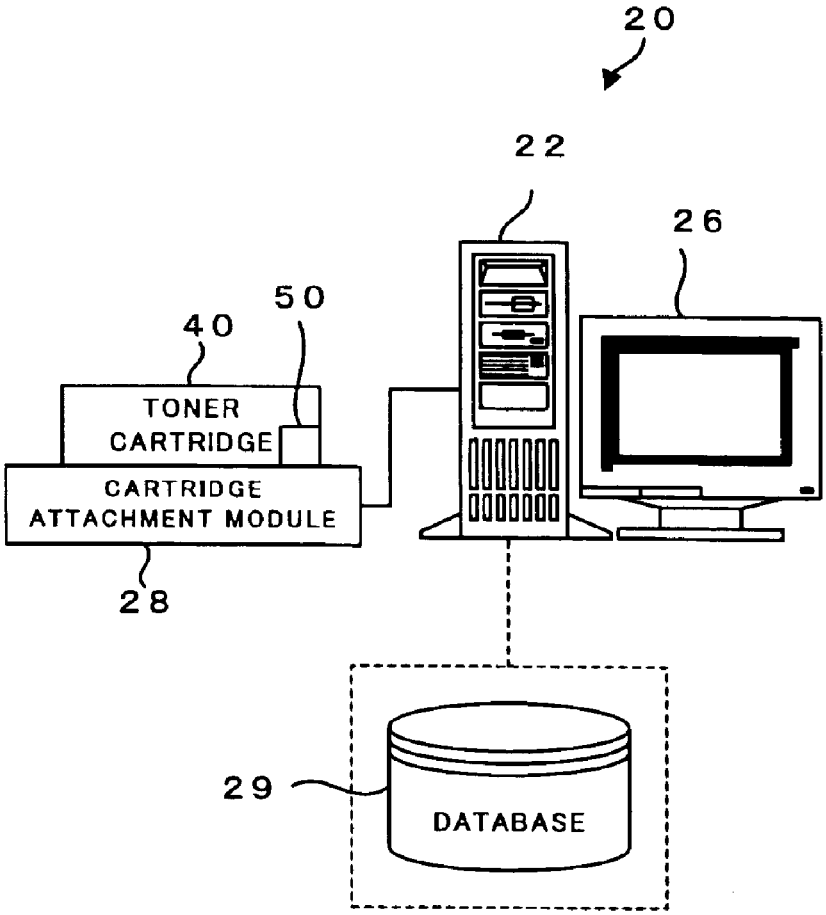
FIG. 1 schematically illustrates the construction of a main unit replacement verification device 20, which verifies requirement for replacement of a main unit of a color laser printer 60, in one embodiment of the invention.
Figure 2:
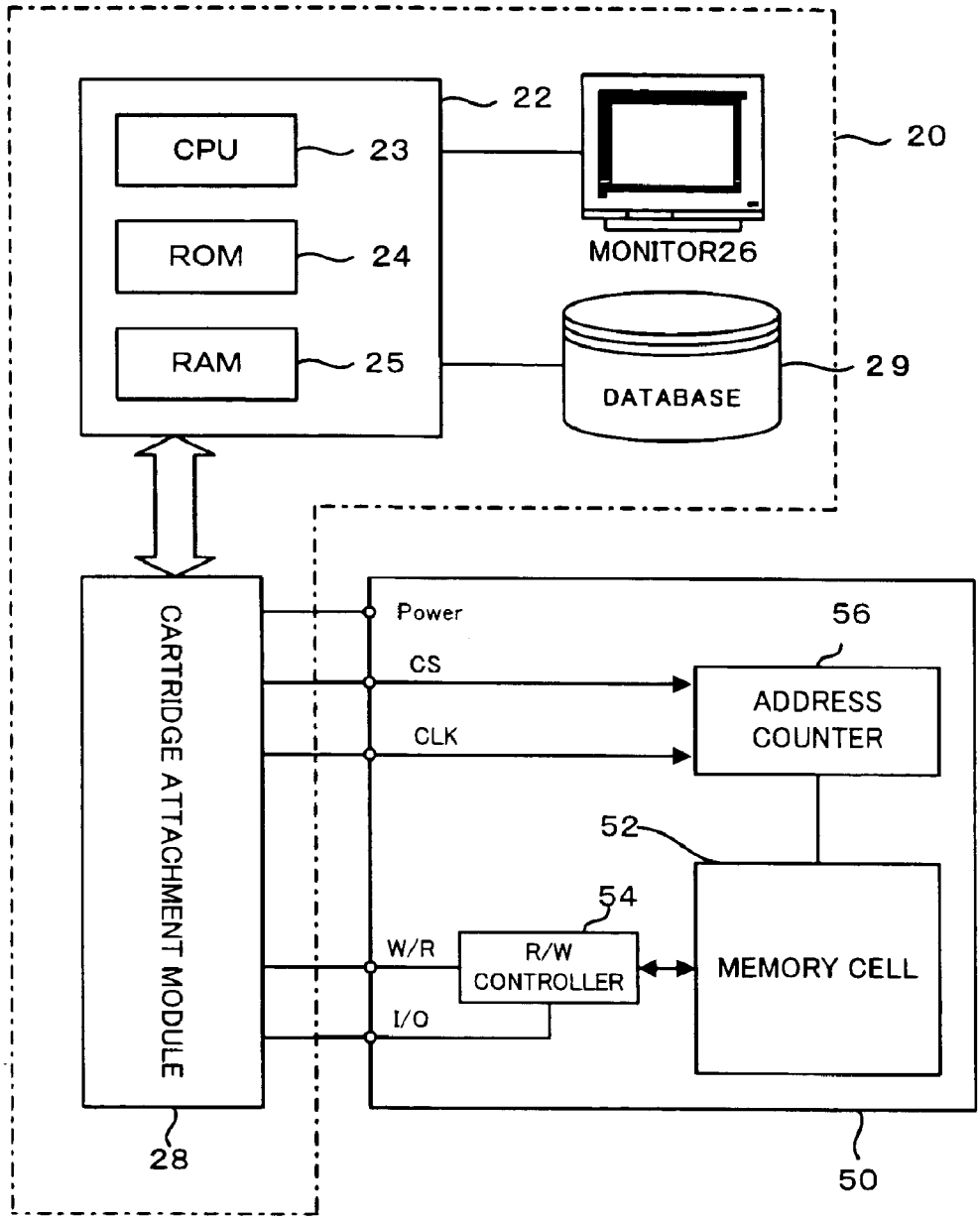
FIG. 2 is a block diagram showing electrical connection of functional blocks in the main unit replacement verification device 20 of the embodiment.

Several preferable embodiments of the invention are discussed below. FIG. 1 schematically illustrates the construction of a main unit replacement verification device 20, which verifies requirement for replacement of a main unit of a color laser printer 60, in one embodiment of the invention. FIG. 2 is a block diagram showing electrical connection of functional blocks in the main unit replacement verification device 20 of the embodiment. As shown in FIGS. 1 and 2, the main unit replacement verification device 20 of the embodiment includes a general-purpose computer assembly 22 including a CPU 23, a ROM 24, a RAM 25, and a non-illustrated input-output interface, a monitor 26 connected to the computer assembly 22, a database 29 installed in the computer assembly 22, and a cartridge attachment module 28 that is connected with the computer assembly 22 via the non-illustrated input-output interface and receives a toner cartridge 40 attached thereto. The main unit replacement verification device 20 reads information on use of the color laser printer (discussed later) from a storage element 50 of the toner cartridge 40, which is attached to the cartridge attachment module 28, and verifies requirement for replacement of the main unit of the color laser printer.

Figure 3:
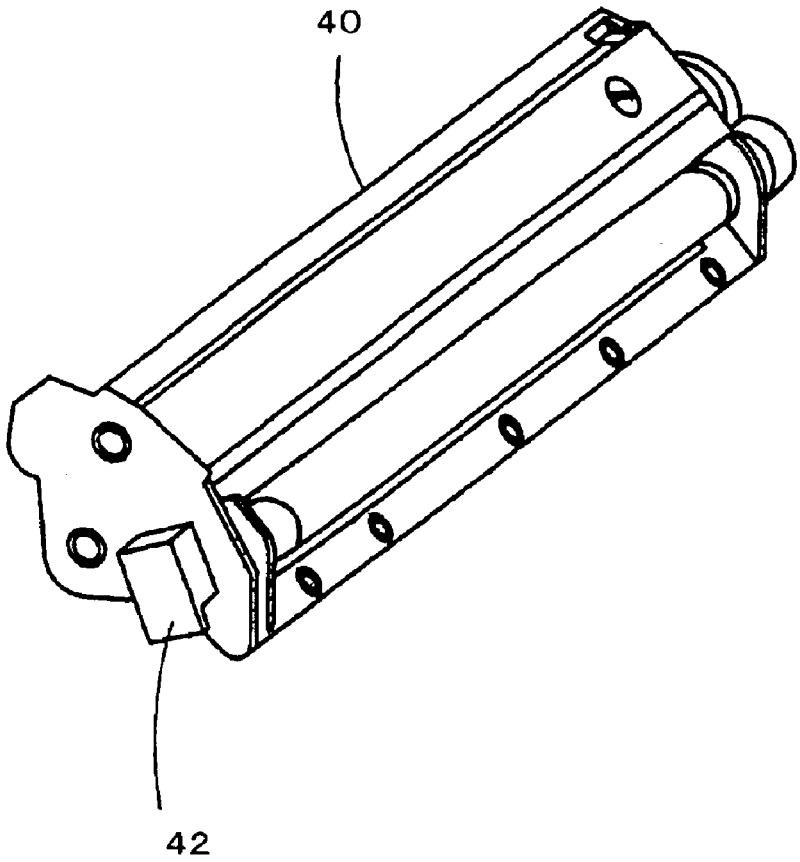
FIG. 3 shows the appearance of the toner cartridge 40.

As shown in FIG. 2, the storage element 50 has a memory cell 52 that stores data therein, a read/write controller 54 that controls operations of reading and writing data from and into the memory cell 52, and an address counter 56 that transmits data to and from the main unit replacement verification device 20 of the embodiment and a controller included in the main unit of the color laser printer via the read/write controller 54 in response to a clock signal CLK. A typical example of the storage element is an EEPROM. FIG. 3 shows the appearance of the toner cartridge 40. The storage element 50 is set inside a holder 42, which is attached to one end of the toner cartridge 40 of the embodiment.

Figure 4:
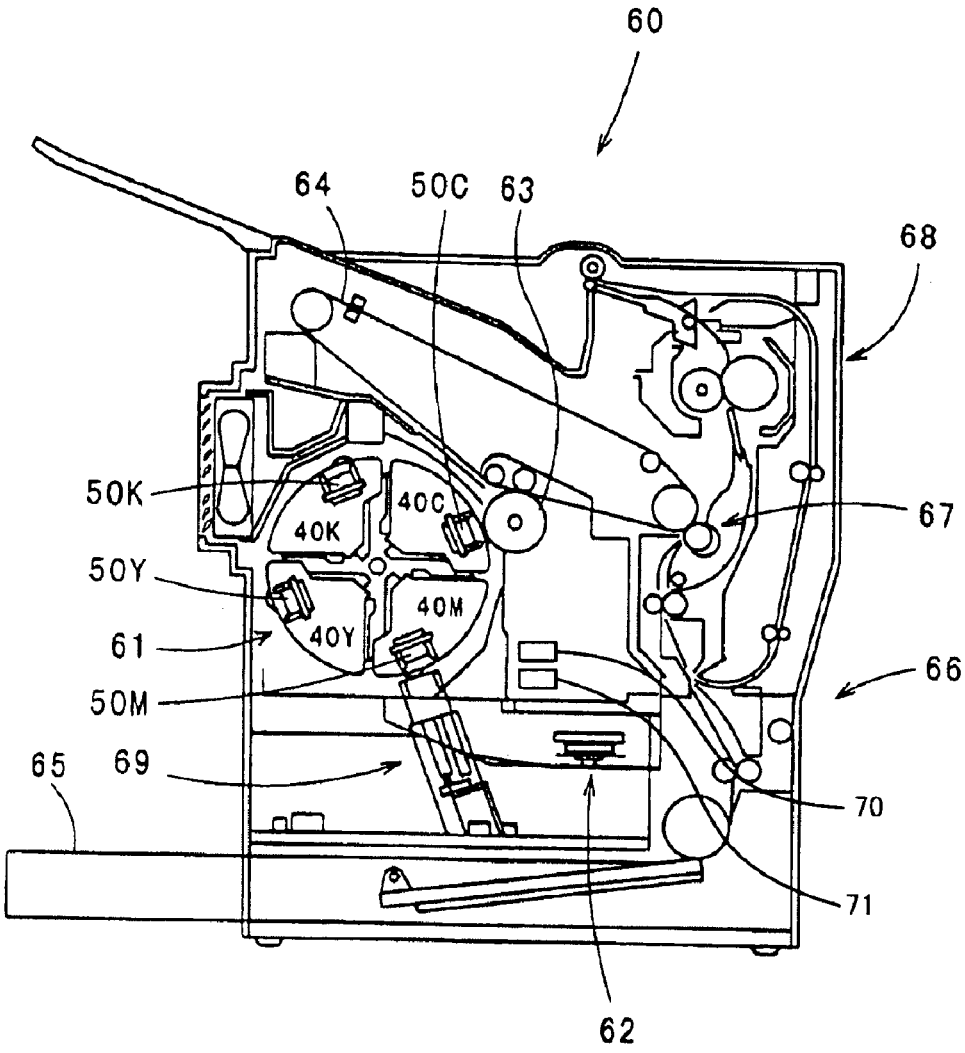
FIG. 4 schematically illustrates the structure of the color laser printer 60 with the toner cartridge 40 attached thereto.

FIG. 4 schematically illustrates the structure of the color laser printer 60 with the toner cartridge 40 attached thereto. The color laser printer 60 with the toner cartridge attached thereto is constructed as a full-color electrophotographic image formation apparatus that adopts a single photoreceptor system and an intermediate transfer system. An original color image is subjected to color separation into four color image components of cyan (C), magenta (M), yellow (Y), and black (K). The system creates electrostatic latent images of the respective color image components on a photoreceptor 63 by means of an exposure unit 62, forms color toner images on the electrostatic latent images with color toners supplied from toner cartridges 40C, 40M, 40Y, and 40K of the respective colors, and transfers the color toner images in an overlapping manner onto a transfer belt 64 as an intermediate transfer member. A secondary transfer unit 67 then functions to transfer the four color toner images, which have been transferred to the transfer belt 64 in the overlapping manner, onto a sheet of printing paper that is supplied from a paper cassette 65 and is fed by means of a feeder unit 66. Resulting color images are completed on the printing paper by fusing and fixing the transferred toner images on the printing paper by means of a fixation unit 68. A developer 61 is designed to be rotatable and form the respective color toner images on the photoreceptor 63. The color laser printer 60 has a temperature sensor 70 and a humidity sensor 71 to measure the temperature and the humidity at the installation location where the color laser printer 60 is installed. The color laser printer 60 is also provided with a movable connection module 69 that connects with each of storage elements 50C, 50M, 50Y, and 50K of the respective toner cartridges 40C, 40M, 40Y, and 40K attached to the developer 61, when the corresponding storage element is located at a lower right position in the drawing. The controller (not shown) of the color laser printer 60 writes the information on the use of the color laser printer 60 into the storage element connected with the movable connection module 69. The electrical connection of the controller of the color laser printer 60 with each of the storage elements is similar to the electrical connection of the main unit replacement verification device 20 with the storage element 50 and is thus not specifically illustrated nor described here.

FIG. 5 shows one example of the information stored in the storage element 50 of the toner cartridge 40. The information stored in the storage element 50 of this embodiment includes information on the toner cartridge 40, for example, an ID allocated to the toner cartridge 40 (cartridge ID), the color of a toner filled in the toner cartridge 40, an ID allocated to the color laser printer 60, to which the toner cartridge 40 is attached (printer ID), a cartridge attachment date when the toner cartridge 40 was attached to the color laser printer 60, a cartridge detachment date when the toner cartridge 40 was detached from the color laser printer 60, a number of prints on which images have been printed with the toner cartridge 40 by the color laser printer 60, and a residual quantity of the toner remaining in the toner cartridge 40. The information stored in the storage element 50 also includes information on the cumulative use of the color laser printer 60, for example, a use start date when the color laser printer 60 was purchased and the use of the color laser printer 60 started, a total number of the toner cartridges 40 attached to the color laser printer 60 for use, a total consumption of the toners consumed in the color laser printer 60, a total number of prints by the color laser printer 60, and a lowest temperature, a highest temperature, a lowest humidity, and a highest humidity at the installation location of the color laser printer 60. Among these pieces of information, the cartridge ID and the toner color have been written into the storage element 50 at a factory or another work site at the time of manufacture or recycle of the toner cartridge 40. The other pieces of the information on the toner cartridge 40 and the information on the cumulative use of the color laser printer 60 are written into the storage element 50 by the color laser printer 60, when the toner cartridge 40 is attached to the color laser printer 60 or when the toner cartridge 40 is detached from the color laser printer 60. The pieces of the information on the use of the toner cartridge 40, for example, the number of prints with the toner cartridge 40 and the residual quantity of the toner, are utilized to judge the advisability of recycle of the toner cartridge 40.

Figure 6:
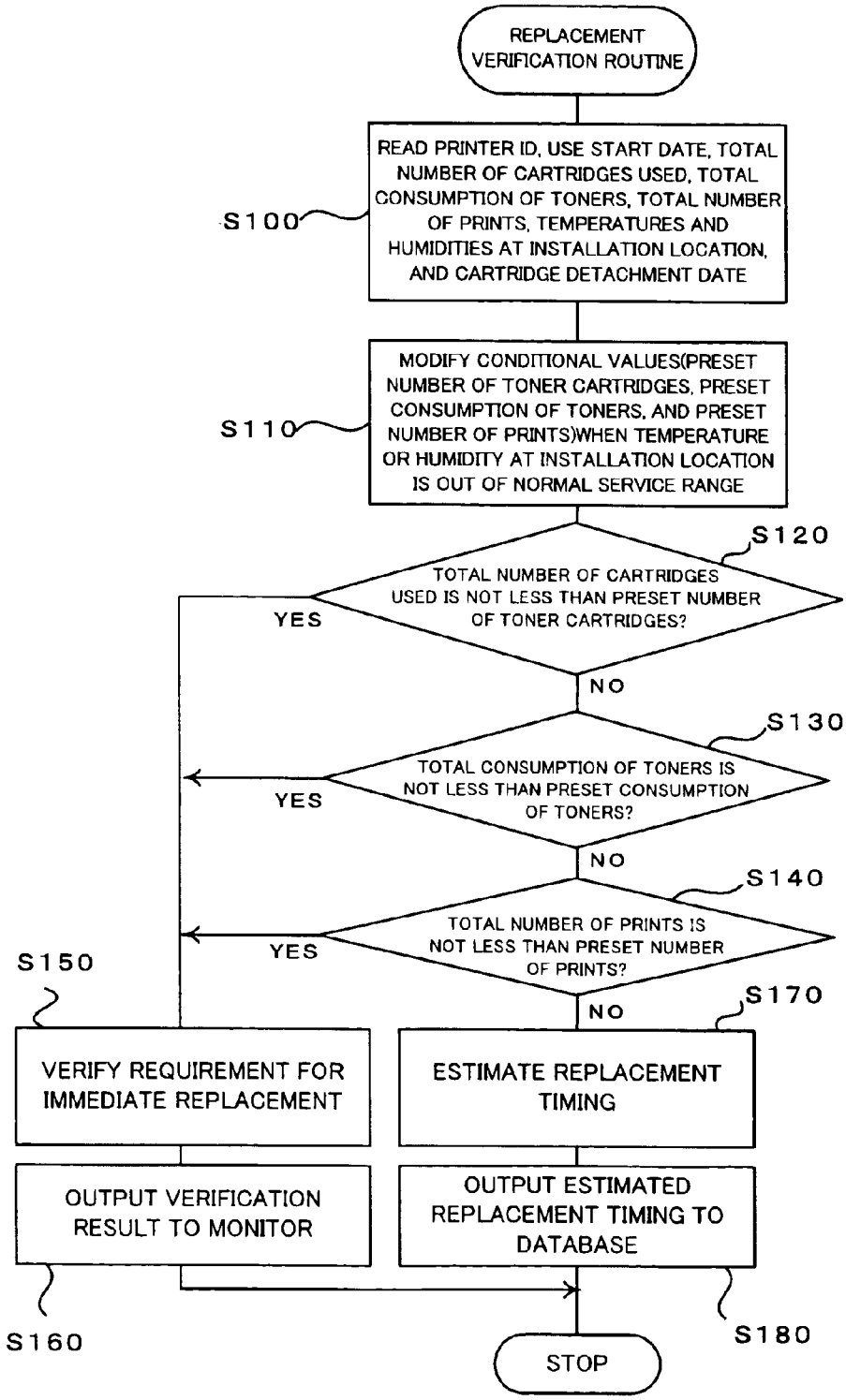
FIG. 6 is a flowchart showing a replacement verification routine executed by the main unit replacement verification device 20.

The main unit replacement verification device 20 of the embodiment works as discussed below. Series of processing executed by the main unit replacement verification device 20 include a replacement verification routine shown in the flowchart of FIG. 6 and a replacement schedule output routine shown in the flowchart of FIG. 7.

The replacement verification routine is executed by the main unit replacement verification device 20 of the embodiment, in response to attachment of the toner cartridge 40 to the cartridge attachment module 28. When the program enters the replacement verification routine of FIG. 6, the main unit replacement verification device 20 of the embodiment first reads the printer ID, the cartridge detachment date, and the information on the cumulative use of the color laser printer 60, such as the use start date, the total number of the cartridges used, the total consumption of the toners, the total number of prints, and the temperatures and the humidities at the installation location, from the storage element 50 of the toner cartridge 40 (step S100). The operation of reading such information is triggered by a read signal, which is output from the computer assembly 22 to the read/write controller 54 included in the storage element 50 of the toner cartridge 40 attached to the cartridge attachment module 28.

When either the temperature or the humidity at the installation location is out of its normal service range, conditional values are modified (step S110). The conditional values are used as reference values in the process of verifying the requirement for replacement of the main unit of the color laser printer 60 as discussed later. The normal service ranges of the temperature and the humidity at the installation location are specified experimentally or by another suitable technique and respectively represent allowable temperature and humidity ranges for normal use of the color laser printer 60. The procedure of this embodiment modifies the conditional values to 0.8-fold values, when either the temperature or the humidity at the installation location is out of its normal service range. The conditional values used in this embodiment are a preset number of toner cartridges (for example, 48 units) as a reference value relative to the total number of the toner cartridges 40 used in the color laser printer 60, a preset consumption of toners (for example, 8000 g) as a reference value relative to the total consumption of the toners, and a preset number of prints (for example, 240,000 sheets) as a reference value relative to the tonal number of prints on which images have been printed by the color laser printer 60. The normal service range of the temperature at the installation location is specified as 10° C. to 45° C., and the normal service range of the humidity at the installation location is specified as 10% to 80%.

Based on the total number of the cartridges used, the total consumption of the toners, and the total number of prints read at step S100, it is successively determined whether the total number of the cartridges used in the color laser printer 60 is not less than the preset number of toner cartridges, whether the total consumption of the toners is not less than the preset consumption of toners, and whether the total number of prints is not less than the preset number of prints (steps S120 through 140). This verifies requirement or non-requirement for replacement of the main unit of the color laser printer 60. When the results of such determination satisfy any of the conditions that the total number of the cartridges used in the color laser printer 60 is not less than the preset number of toner cartridges, that the total consumption of the toners is not less than the preset consumption of toners, and that the total number of prints is not less than the preset number of prints, it is verified that immediate replacement of the main unit of the color laser printer 60 is required (step S150). The result of the verification is output to the monitor 26 (step S160), and the program exits from the replacement verification routine.

When the results of the determination satisfy all the conditions that the total number of the cartridges used in the color laser printer 60 is less than the preset number of toner cartridges, that the total consumption of the toners is less than the preset consumption of toners, and that the total number of prints is less than the preset number of prints, on the other hand, it is verified that immediate replacement of the main unit of the color laser printer 60 is not required and a replacement timing of the main unit is estimated (step S170). The estimation of the replacement timing in this embodiment computes an expected number of days prior to requirement for immediate replacement in the verification process (steps S120 through S140) based on the use start date, the cartridge detachment date, the total number of the cartridges used, the total consumption of the toners, and the total number of prints, and estimates the replacement timing of the main unit of the color laser printer 60. A concrete procedure divides a number of days elapsing between the use start date when the color laser printer 60 was purchased and the use of the color laser printer 60 started and the cartridge detachment date by each piece of the cumulative use information (that is, the total number of the cartridges used, the total consumption of the toners, or the total number of prints) to calculate a number of days per unit volume. The procedure then calculates a difference between the current actual value of each piece of the cumulative use information and the corresponding conditional value used as the reference value in the verification process (that is, the preset number of toner cartridges, the preset consumption of toners, or the preset number of prints), and multiplies the calculated number of days per unit volume by the calculated difference of the conditional value to compute an expected number of days until each piece of the cumulative use information reaches the corresponding conditional value. Among the expected number of days thus computed, a minimum number of days until at least one piece of the cumulative use information reaches the corresponding conditional value at the earliest timing are added to the cartridge detachment date. The result of the addition is estimated as the replacement timing of the main unit of the color laser printer 60.

Figures 7, 8:
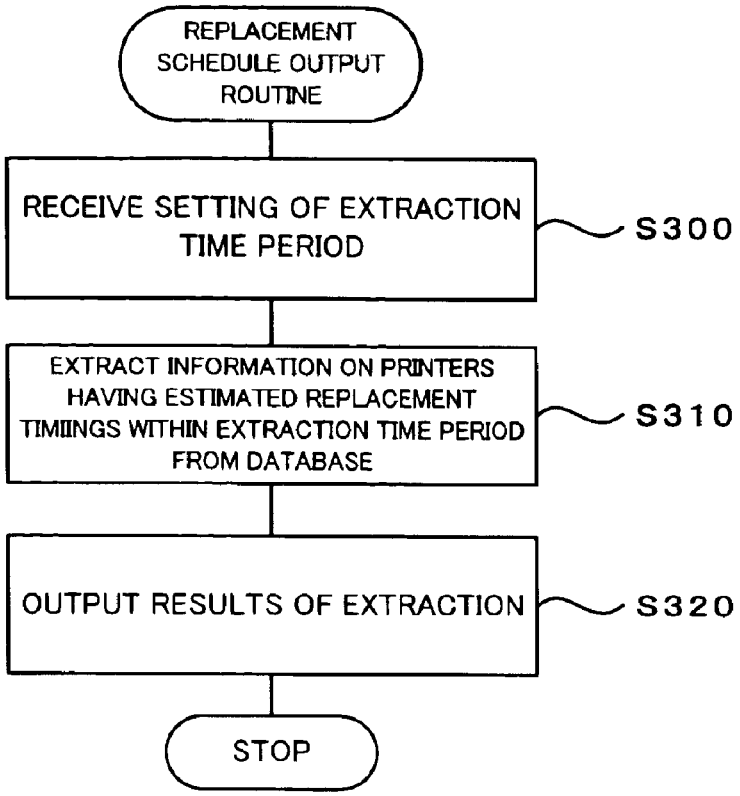
FIG. 7 is a flowchart showing a replacement schedule output routine executed by the main unit replacement verification device 20.
FIG. 8 shows an example of the information stored in the database.

After estimation of the replacement timing of the main unit, the estimated replacement timing is output to the database (step S180). The program then exits from the replacement verification routine. FIG. 8 shows an example of the information stored in the database. The information stored in the database 29 of the embodiment includes the ID allocated to the color laser printer 60 (printer ID), the type of the color laser printer 60, an ID allocated to the customer owning the color laser printer 60 (customer ID), the name and the postal address of the customer, and the estimated replacement timing of the main unit according to the replacement verification routine. Among these pieces of information, the information on the color laser printer 60, such as the printer ID and the printer type, has been stored in advance in relation to the customer-related information, such as the customer ID and the name of the customer. In this embodiment, the output to the database stores the estimated replacement timing of the main unit in relation to the information on the corresponding color laser printer 60.

Figure 9:
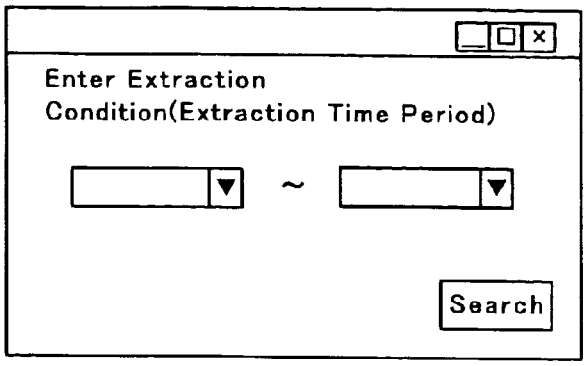
FIG. 9 shows one example of the extraction time period input window.

The replacement schedule output routine is executed by the main unit replacement verification device 20 of the embodiment, in response to a replacement schedule output instruction. When the program enters the replacement schedule output routine shown in FIG. 7, the main unit replacement verification device 20 of the embodiment first receives a setting of an extraction time period as an extraction condition (step S300). The structure of the embodiment outputs an extraction time period input window to the monitor 26 to receive an entry of the extraction time period. One example of the extraction time period input window is shown in FIG. 9. In the illustrated example, the operator enters a starting point and an end point of the extraction time period on the extraction time period input window to set the extraction time period.

The main unit replacement verification device 20 extracts the information on respective color laser printers 60 from the database, based on the setting of the extraction time period (step S310). Specifically the procedure of the embodiment extracts the information on the color laser printers 60 having the estimated replacement timings within the setting of the extraction time period from the database 29.

Figure 10:
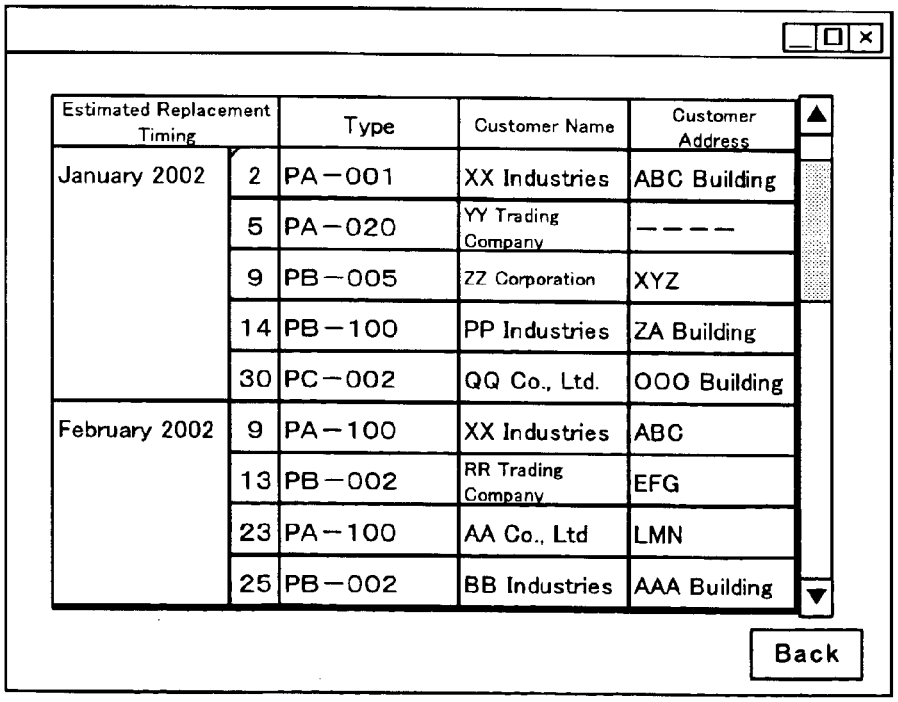
FIG. 10 shows one example of the replacement schedule output window.

The main unit replacement verification device 20 subsequently outputs the information on the color laser printers 60 extracted from the database (step S320). The structure of the embodiment outputs a replacement schedule output window, on which the information on the color laser printers 60 is to be output in display, to the monitor 26. One example of the replacement schedule output window is shown in FIG. 10. In the illustrated example, sets of the extracted information on the respective color laser printers 60 are enumerated by each year and month of the replacement timings of the main units on the replacement schedule output window to show the replacement schedule of the main units in the respective years and months. The replacement schedule output routine is terminated after output of the information on the color laser printers 60 extracted from the database.

As discussed above, the main unit replacement verification device 20 of the embodiment can verify the requirement for replacement of the main unit of the color laser printer 60 by simple attachment of the toner cartridge 40, which has been attached to and detached from the color laser printer 60, to the cartridge attachment module 28. The requirement for replacement is verified, based on the information on the use of each color laser printer 60. This ensures adequate verification of the requirement for replacement. The replacement timing is estimated appropriately by taking into account the time-related information on the use of the color laser printer 60.

The main unit replacement verification device 20 of the embodiment successively determines whether the total number of the cartridges used is not less than the preset number of toner cartridges, whether the total consumption of the toners is not less than the preset consumption of toners, and whether the total number of prints is not less than the preset number of prints to verify the requirement for replacement of the main unit of the color laser printer 60. One modified procedure may verify the requirement for replacement of the main unit of the color laser printer 60, based on any one or two of such determinations. One example verifies the requirement or non-requirement for replacement of the main unit, based on only the determination of whether the total number of the cartridges used is not less than the preset number of toner cartridges. The main unit replacement verification device 20 of the embodiment uses the total number of the cartridges used, the total consumption of the toners, and the total number of prints as the verification conditions. Other pieces of the information on the use of the color laser printer 60 may alternatively be used as the verification conditions.

The main unit replacement verification device 20 of the embodiment verifies the requirement for immediate replacement of the color laser printer 60, when any of the conditions is fulfilled, that is, when the total number of the cartridges used is not less than the preset number of toner cartridges, when the total consumption of the toners is not less than the preset consumption of toners, or when the total number of prints is not less than the preset number of prints. One possible modification may verify the requirement for replacement only when all these conditions are fulfilled. Namely the requirement for immediate replacement of the color laser printer 60 is verified when the total number of the cartridges used is not less than the preset number of toner cartridges, when the total consumption of the toners is not less than the preset consumption of toners, and when the total number of prints is not less than the preset number of prints.

With respect to each of the color laser printers 60 that do not require immediate replacement, the main unit replacement verification device 20 of the embodiment computes the expected number of days prior to requirement for immediate replacement in the verification process, based on the use start date, the cartridge detachment date, the total number of the cartridges used, the total consumption of the toners, and the total number of prints, and estimates the replacement timing of the main unit of each color laser printer 60. These pieces of the information are not restrictive at all. These pieces of the information may be replaced by any pieces of time-related information on the use of the color laser printer 60, which allow for estimation of the replacement timing. Another modified procedure may not estimate the replacement timing but may carry out only verification of the requirement for immediate replacement.

Figure 11:
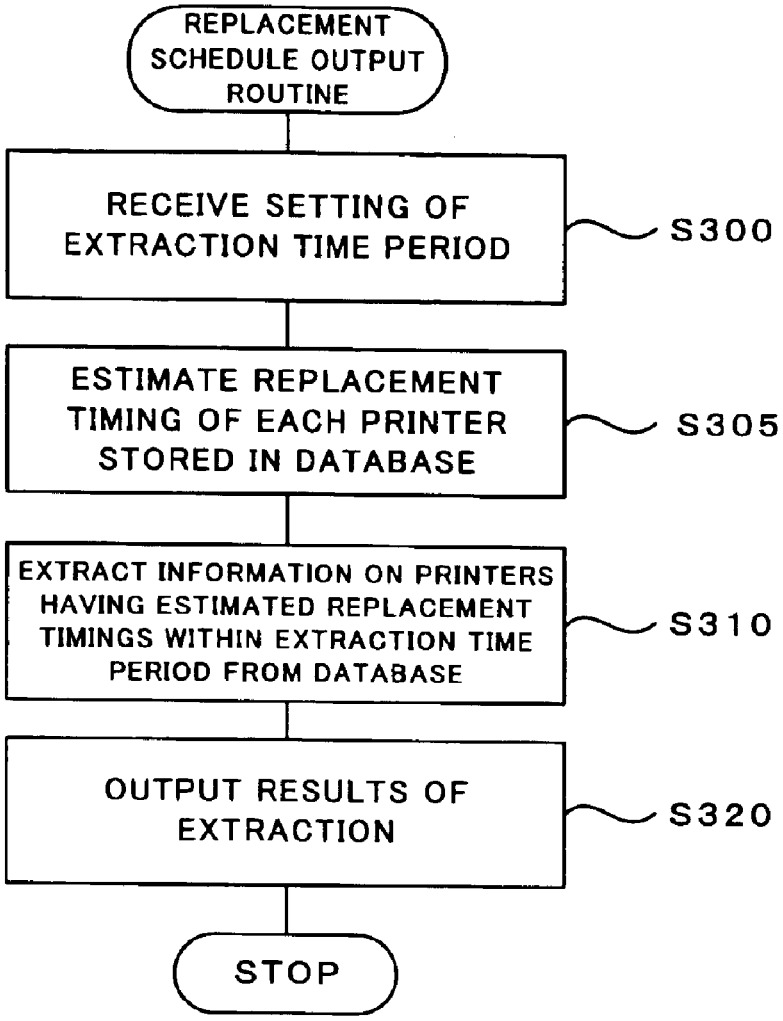
FIG. 11 is a flowchart showing a replacement schedule output routine in one modified example.

The main unit replacement verification device 20 of the embodiment writes the estimated replacement timing into the database 29. One modified procedure may not estimate the replacement timing but may directly write the input pieces of the information on the use of the color laser printer 60 into the database 29. In this modified arrangement, estimation of the replacement timing is performed in the replacement schedule output routine. A replacement schedule output routine shown in the flowchart of FIG. 11 is thus substituted for the replacement schedule output routine shown in the flowchart of FIG. 7. After reception of the setting of the extraction time period (step S300), the routine estimates a replacement timing of the main unit of each color laser printer 60 stored in the database 29 (step S305), and extracts and outputs the sets of information on the respective color laser printers 60 having the estimated replacement timings within the setting of the extraction time period (steps S310 and S320).

In the main unit replacement verification device 20 of the embodiment, the database 29 is installed in the computer assembly 22. The database may have any other suitable arrangement, as long as the database is accessible from the computer assembly 22. For example, the database may be installed in another computer accessible via a network.

The main unit replacement verification device 20 of the embodiment has the database 29 and outputs the estimated replacement timings to the database 29. One modified structure may not have the database 29 and may output the estimated replacement timings to the monitor 26.

The main unit replacement verification device 20 of the embodiment modifies the conditional values when the input temperature or humidity at the installation location is out of the corresponding normal service range. The temperature and the humidity at the installation location are not restrictive at all. Another adequate piece of information may be used as the criterion to determine the requirement for modification of the conditional values. Another possible arrangement may not modify the conditional values according to the input temperature and humidity at the installation location.

The main unit replacement verification device 20 of the embodiment verifies the requirement for replacement of the main unit of the color laser printer 60, which is constructed as a full-color electrophotographic image formation apparatus adopting the single photoreceptor system and the intermediate transfer system. In this structure of the embodiment, the toner cartridge 40 has the storage element 50 to store the information on the use of the color laser printer 60. The technique of the invention is also applicable to verify the requirement for replacement of the main body of any of other color laser printers and photocopiers constructed as full-color electrophotographic image formation apparatuses adopting a multi-photoreceptor system and a direct transfer system and laser printers and photocopiers constructed as monochrome electrophotographic image formation apparatuses.

The embodiment regards the main unit replacement verification device 20 that verifies the requirement for replacement of the main unit of the color laser printer 60, which writes the use-related information into the storage element 50 of the toner cartridge 40 attached to the color laser printer 60. Other applications of the invention include a corresponding method of verifying the requirement for replacement of the main unit of the color laser printer 60, a program that causes the computer assembly 22 connecting with the cartridge attachment module 28 to function as the main unit replacement verification device 20 of the embodiment, and a program that causes the computer assembly 22 to execute the corresponding method of verifying the requirement for replacement of the main unit of the color laser printer 60. In the applications of the programs, the respective steps of the replacement verification routine shown in FIG. 6 and the replacement schedule output routine shown in FIG. 7 are programmed in an adequate programming language.

The above description regards the main unit replacement verification device 20 that verifies the requirement for replacement of the main body of the color laser printer 60, as well as its modified examples. A component replacement verification device 20B of another embodiment is described below, which verifies requirement for replacement of the respective components, such as the exposure unit 62, the photoreceptor 63, and the transfer belt 64, included in the color laser printer 60.

The component replacement verification device 20B of this embodiment has the identical hardware structure with that of the main unit replacement verification device 20 shown in FIGS. 1 and 2. In order to avoid duplicated explanation, the respective hardware components of the component replacement verification device 20B in the embodiment are shown by the same symbols and numerals as those used for the main unit replacement verification device 20 and are not specifically described here.

FIG. 12 shows one example of information written into the storage element 50 of the toner cartridge 40 to verify the requirement for replacement of each component of the color laser printer 60. The information stored in the storage element 50 of this embodiment includes information on the use of the toner cartridge 40, as well as information on the cumulative use of the color laser printer 60 by component since attachment of the respective components to the color laser printer 60, for example, the exposure unit 62, the photoreceptor 63, and the transfer belt 64. The information on the use of the toner cartridge 40 includes an ID allocated to the toner cartridge 40 (cartridge ID), the color of a toner filled in the toner cartridge 40, an ID allocated to the color laser printer 60, to which the toner cartridge 40 is attached (printer ID), a cartridge attachment date when the toner cartridge 40 was attached to the color laser printer 60, a cartridge detachment date when the toner cartridge 40 was detached from the color laser printer 60, a number of prints on which images have been printed with the toner cartridge 40 by the color laser printer 60, and a residual quantity of the toner remaining in the toner cartridge 40. The information on the cumulative use of the color laser printer 60 by component includes a use start date when the use of each component started, a total number of the toner cartridges 40 attached to the color laser printer 60 for use, a total consumption of the toners consumed in the color laser printer 60, a total number of prints by the color laser printer 60, and a lowest temperature, a highest temperature, a lowest humidity, and a highest humidity at the installation location of the color laser printer 60. Among these pieces of information, the cartridge ID and the toner color have been written into the storage element 50 at a factory or another work site at the time of manufacture or recycle of the toner cartridge 40. The other pieces of the information on the toner cartridge 40 and the information on the cumulative use of the color laser printer 60 are written into the storage element 50 by the color laser printer 60, when the toner cartridge 40 is attached to the color laser printer 60 or when the toner cartridge 40 is detached from the color laser printer 60. The pieces of the information on the use of the toner cartridge 40, for example, the number of prints with the toner cartridge 40 and the residual quantity of the toner, are utilized to judge the advisability of recycle of the toner cartridge 40.

Figure 13:
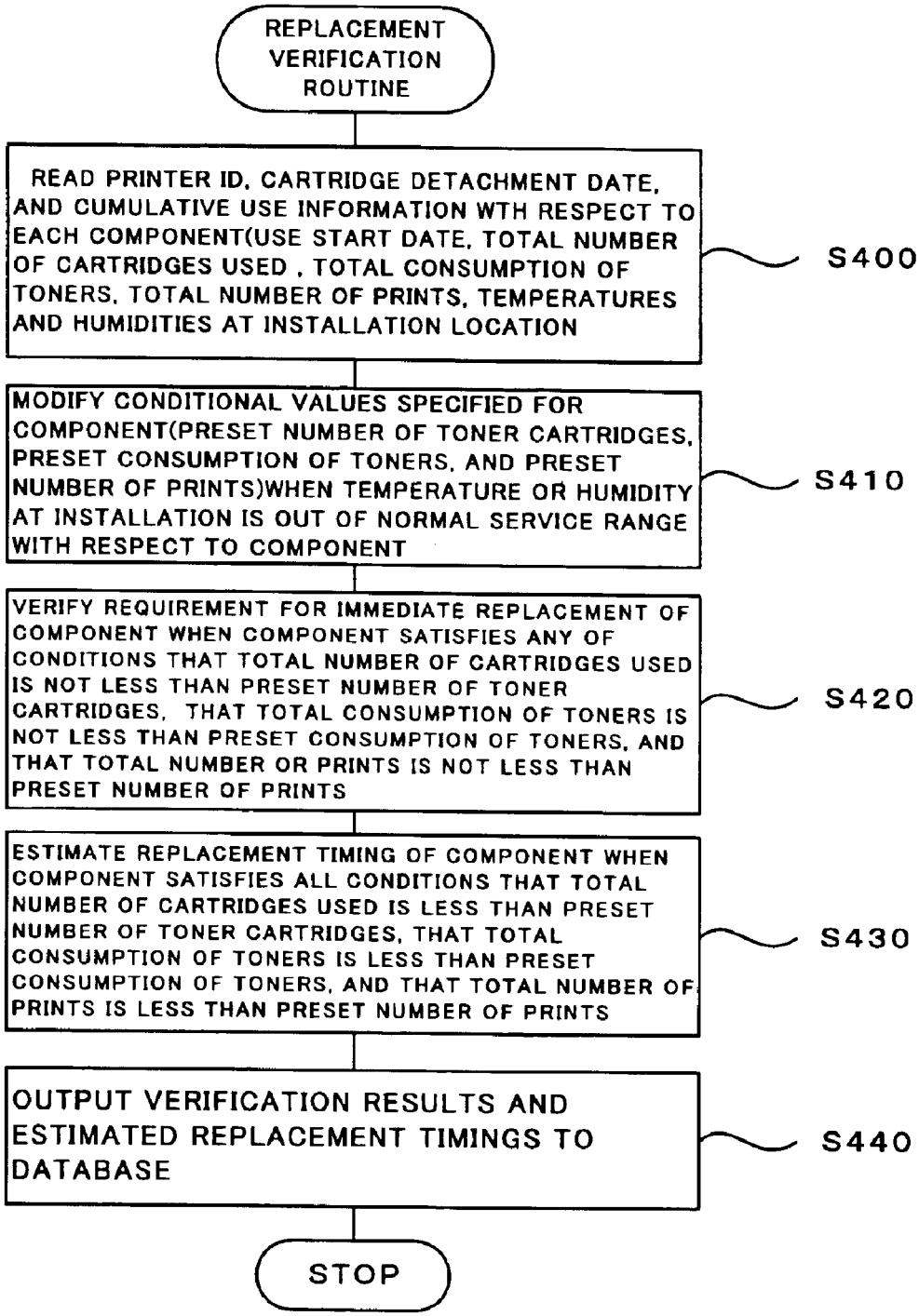
FIG. 13 is a flowchart showing a replacement verification routine executed by the component replacement verification device 20B.

The component replacement verification device 20B of the embodiment works as discussed below. Series of processing executed by the component replacement verification device 20B include a replacement verification routine shown in the flowchart of FIG. 13 and a replacement schedule output routine shown in the flowchart of FIG. 14.

The replacement verification routine is executed by the component replacement verification device 20B of the embodiment, in response to attachment of the toner cartridge 40 to the cartridge attachment module 28. When the program enters the replacement verification routine of FIG. 13, the component replacement verification device 20B of the embodiment first reads the information on the toner cartridge 40, such as the printer ID and the cartridge detachment date, and the information on the cumulative use of the color laser printer 60 stored by component, such as the use start date, the total number of the cartridges used, the total consumption of the toners, the total number of prints, and the temperatures and the humidities at the installation location, from the storage element 50 of the toner cartridge 40 (step S400). The operation of reading such information is triggered by a read signal, which is output from the computer assembly 22 to the read/write controller 54 included in the storage element 50 of the toner cartridge 40 attached to the cartridge attachment module 28.

When either the temperature or the humidity at the installation location is out of its normal service range with respect to each component, conditional values specified for the component are modified (step S410). The conditional values specified for each component are used as reference values in the process of verifying the requirement for replacement of the component of the color laser printer 60 as discussed later. The normal service ranges of the temperature and the humidity at the installation location are specified experimentally or by another suitable technique and respectively represent allowable temperature and humidity ranges for normal use of the color laser printer 60. When either the temperature or the humidity at the installation location is out of its normal service range with respect to a component, the procedure of this embodiment modifies the conditional values specified for the component to 0.8-fold values. The conditional values used in this embodiment are specified for each component as a preset number of toner cartridges (for example, 48 units) as a reference value relative to the total number of the toner cartridges 40 used in the color laser printer 60, a preset consumption of toners (for example, 8000 g) as a reference value relative to the total consumption of the toners, and a preset number of prints (for example, 240,000 sheets) as a reference value relative to the tonal number of prints on which images have been printed by the color laser printer 60. The normal service range of the temperature at the installation location is set as 10° C. to 45° C., and the normal service range of the humidity at the installation location is set as 10% to 80%. These settings are commonly used for all the components.

Based on the information on the cumulative use of the color laser printer 60 by component read at step S400 (that is, the total number of the cartridges used, the total consumption of the toners, and the total number of prints), it is successively determined with respect to each of the components whether the total number of the cartridges used is not less than the preset number of toner cartridges, whether the total consumption of the toners is not less than the preset consumption of toners, and whether the total number of prints is not less than the preset number of prints. When the results of such determination with respect to a certain component satisfy any of the conditions that the total number of the cartridges used is not less than the preset number of toner cartridges, that the total consumption of the toners is not less than the preset consumption of toners, and that the total number of prints is not less than the preset number of prints, it is verified that immediate replacement of the certain component is required (step S420).

When the results of the determination with respect to the certain component satisfy all the conditions that the total number of the cartridges used is less than the preset number of toner cartridges, that the total consumption of the toners is less than the preset consumption of toners, and that the total number of prints is less than the preset number of prints, on the other hand, it is verified that immediate replacement of the certain component is not required and a replacement timing of the certain component is estimated (step S430). The estimation of the replacement timing of the certain component in this embodiment computes an expected number of days prior to requirement for immediate replacement in the verification process, based on the use start date, the cartridge detachment date, the total number of the cartridges used, the total consumption of the toners, and the total number of prints, and estimates the replacement timing of the certain component. A concrete procedure divides a number of days elapsing between the use start date when the use of the certain component started and the cartridge detachment date by each piece of the cumulative use information (that is, the total number of the cartridges used, the total consumption of the toners, or the total number of prints) to calculate a number of days per unit volume. The procedure then calculates a difference between the current actual value of each piece of the cumulative use information and the corresponding conditional value used as the reference value in the verification process (that is, the preset number of toner cartridges, the preset consumption of toners, or the preset number of prints), and multiplies the calculated number of days per unit volume by the calculated difference of the conditional value to compute an expected number of days until each piece of the cumulative use information reaches the corresponding conditional value. Among the expected number of days thus computed, a minimum number of days until at least one piece of the cumulative use information reaches the corresponding conditional value at the earliest timing are added to the cartridge detachment date. The result of the addition is estimated as the replacement timing of the certain component.

Figures 14, 15:
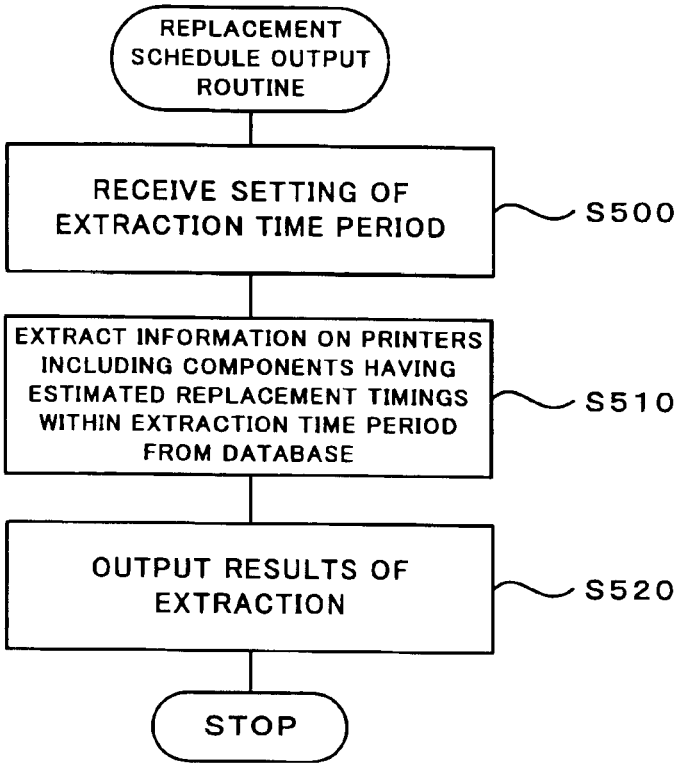
FIG. 14 is a flowchart showing a replacement schedule output routine executed by the component replacement verification device 20B.
FIG. 15 shows an example of the information stored in the database.

After estimation of the replacement timings of the components that do not require immediate replacement, the verification results of the requirement for replacement of the respective components and the estimated replacement timings are output to the database (step S440). The program then exits from the replacement verification routine. FIG. 15 shows an example of the information stored in the database. The information stored in the database 29 of the embodiment includes the ID allocated to the color laser printer 60 (printer ID), the type of the color laser printer 60, an ID allocated to the customer owning the color laser printer 60 (customer ID), the name and the postal address of the customer, and the estimated replacement timings of the respective components according to the replacement verification routine. Among these pieces of information, the information on the color laser printer 60, such as the printer ID and the printer type, has been stored in advance in relation to the customer-related information, such as the customer ID and the name of the customer. In this embodiment, the output to the database stores the estimated replacement timings of the respective components in relation to the information on the corresponding color laser printer 60. With respect to the components that require immediate replacement, the execution dates of the replacement verification routine are stored as the estimated replacement timings of the components.

The replacement schedule output routine is executed by the component replacement verification device 20B of the embodiment, in response to a replacement schedule output instruction. When the program enters the replacement schedule output routine shown in FIG. 14, the component replacement verification device 20B of the embodiment first receives a setting of an extraction time period as an extraction condition (step S500). The structure of the embodiment outputs an extraction time period input window to the monitor 26 to receive an entry of the extraction time period. One example of the extraction time period input window is shown in FIG. 16. In the illustrated example, the operator enters a starting point and an end point of the extraction time period on the extraction time period input window to set the extraction time period.

The component replacement verification device 20B extracts the information on respective color laser printers 60 from the database, based on the setting of the extraction time period (step S510). Specifically the procedure of the embodiment extracts the information on the color laser printers 60 including the components having the estimated replacement timings within the setting of the extraction time period from the database 29.

The component replacement verification device 20B subsequently outputs the information on the color laser printers 60 extracted from the database (step S520). The structure of the embodiment outputs a replacement schedule output window, on which the information on the color laser printers 60 is to be output in display, to the monitor 26. One example of the replacement schedule output window is shown in FIG. 17. In the illustrated example, sets of the extracted information on the respective color laser printers 60 are enumerated by each year and month of the estimated replacement timings of the components on the replacement schedule output window to show the replacement schedule of the components in the respective years and months. The replacement schedule output routine is terminated after output of the information on the color laser printers 60 extracted from the database.

As discussed above, the component replacement verification device 20B of the embodiment can verify the requirement for replacement of the respective components of the color laser printer 60 by simple attachment of the toner cartridge 40, which has been attached to and detached from the color laser printer 60, to the cartridge attachment module 28. The requirement for replacement is verified, based on the information on the use of the respective components of each color laser printer 60. This ensures adequate verification of the requirement for replacement. The replacement timing is estimated appropriately by taking into account the time-related information on the use of the respective components of the color laser printer 60.

The component replacement verification device 20B of the embodiment successively determines whether the total number of the cartridges used is not less than the preset number of toner cartridges, whether the total consumption of the toners is not less than the preset consumption of toners, and whether the total number of prints is not less than the preset number of prints to verify the requirement for replacement of the respective components of the color laser printer 60. One modified procedure may verify the requirement for replacement of the respective components of the color laser printer 60, based on any one or two of such determinations. One example verifies the requirement or non-requirement for replacement of each component, based on only the determination of whether the total number of the cartridges used is not less than the preset number of toner cartridges. The component replacement verification device 20B of the embodiment uses the total number of the cartridges used, the total consumption of the toners, and the total number of prints as the verification conditions. Other pieces of the information on the use of each component of the color laser printer 60 may alternatively be used as the verification conditions.

The component replacement verification device 20B of the embodiment verifies the requirement for immediate replacement of each component of the color laser printer 60, when any of the conditions is fulfilled with respect to the component, that is, when the total number of the cartridges used is not less than the preset number of toner cartridges, when the total consumption of the toners is not less than the preset consumption of toners, or when the total number of prints is not less than the preset number of prints. One possible modification may verify the requirement for replacement of each component only when all these conditions are fulfilled with respect to the component. Namely the requirement for immediate replacement of each component of the color laser printer 60 is verified when the total number of the cartridges used is not less than the preset number of toner cartridges., when the total consumption of the toners is not less than the preset consumption of toners, and when the total number of prints is not less than the preset number of prints.

With respect to each of the components that do not require immediate replacement, the component replacement verification device 20B of the embodiment computes the expected number of days prior to requirement for immediate replacement in the verification process, based on the use start date, the cartridge detachment date, the total number of the cartridges used, the total consumption of the toners, and the total number of prints, and estimates the replacement timing of each component of the color laser printer 60. These pieces of the information are not restrictive at all. These pieces of the information may be replaced by any pieces of time-related information on the use of each component of the color laser printer 60, which allow for estimation of the replacement timing. Another modified procedure may not estimate the replacement timing but may carry out only verification of the requirement for immediate replacement.

Figure 18:
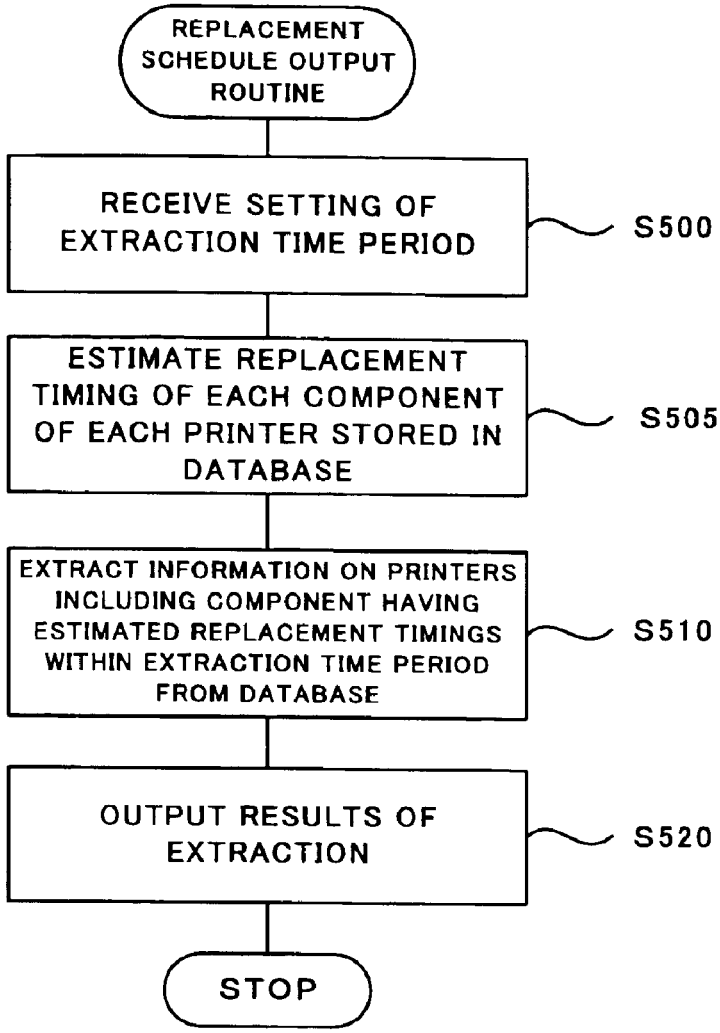
FIG. 18 is a flowchart showing a replacement schedule output routine in another modified example.

The component replacement verification device 20B of the embodiment writes the estimated replacement timing into the database 29. One modified procedure may not estimate the replacement timing but may directly write the input pieces of the information on the cumulative use of the color laser printer 60 into the database 29. In this modified arrangement, estimation of the replacement timing is performed in the replacement schedule output routine. A replacement schedule output routine shown in the flowchart of FIG. 18 is thus substituted for the replacement schedule output routine shown in the flowchart of FIG. 14. After reception of the setting of the extraction time period (step S500), the routine estimates a replacement timing of each component in each of the color laser printers 60 stored in the database 29 (step S505), and extracts and outputs the sets of information on the color laser printers 60 including the components having the estimated replacement timings within the setting of the extraction time period (steps S510 and S520).

In the component replacement verification device 20B of the embodiment, the database 29 is installed in the computer assembly 22. The database may have any other suitable arrangement, as long as the database is accessible from the computer assembly 22. For example, the database may be installed in another computer accessible via a network.

The component replacement verification device 20B of the embodiment has the database 29 and outputs the verification results of the requirement for replacement and the estimated replacement timings to the database 29. One modified structure may not have the database 29 and may output the verification results of the requirement for replacement and the estimated replacement timings to the monitor 26.

The component replacement verification device 20B of the embodiment modifies the conditional values when the input temperature or humidity at the installation location is out of the corresponding normal service range. The temperature and the humidity at the installation location are not restrictive at all. Another adequate piece of information may be used as the criterion to determine the requirement for modification of the conditional values. Another possible arrangement may not modify the conditional values according to the input temperature and humidity at the installation location.

In the component replacement verification device 20B of the embodiment, the components of the color laser printer 60, which are subjected to verification of the requirement for immediate replacement, are the exposure unit 62, the photoreceptor 63, and the transfer belt 64. The technique of verifying the requirement for immediate replacement is also applicable to other components of the color laser printer 60, for example, the paper cassette 65, the feeder unit 66, the secondary transfer unit 67, the fixation unit 68, and the movable connection module 69.

The component replacement verification device 20B of the embodiment verifies the requirement for replacement of each component of the color laser printer 60, which is constructed as a full-color electrophotographic image formation apparatus adopting the single photoreceptor system and the intermediate transfer system. In this structure of the embodiment, the toner cartridge 40 has the storage element 50 to store the information on the use of the respective components of the color laser printer 60. The technique of the invention is also applicable to verify the requirement for replacement of each component of any other color laser printers and photocopiers constructed as full-color electrophotographic image formation apparatuses adopting a multi-photoreceptor system and a direct transfer system and laser printers and photocopiers constructed as monochrome electrophotographic image formation apparatuses.

The embodiment regards the component replacement verification device 20B that verifies the requirement for replacement of each component of the color laser printer 60, which writes the use-related information into the storage element 50 of the toner cartridge 40 attached to the color laser printer 60. Other applications of the invention include a corresponding method of verifying the requirement for replacement of each component of the color laser printer 60, a program that causes the computer assembly 22 connecting with the cartridge attachment module 28 to function as the component replacement verification device 20B of the embodiment, and a program that causes the computer assembly 22 to execute the corresponding method of verifying the requirement for replacement of each component of the color laser printer 60. In the applications of the programs, the respective steps of the replacement verification routine shown in FIG. 13 and the replacement schedule output routine shown in FIG. 14 are programmed in an adequate programming language.

The above description regards the component replacement verification device 20B that verifies the requirement for replacement of each component of the color laser printer 60, as well as its modified examples. A recommendation specification device 20C of another embodiment is described below, which specifies an advisable recommendation for replacement of the color laser printer 60.

The recommendation specification device 20C of this embodiment has the identical hardware structure with that of the main unit replacement verification device 20 shown in FIGS. 1 and 2. In order to avoid duplicated explanation, the respective hardware components of the recommendation specification device 20C in the embodiment are shown by the same symbols and numerals as those used for the main unit replacement verification device 20 and are not specifically described here.

FIG. 19 shows one example of information written into the storage element 50 of the toner cartridge 40 to specify an advisable recommendation for replacement of the color laser printer 60. The information stored in the storage element 50 of this embodiment includes information on the use of the toner cartridge 40 and information on the cumulative use of the color laser printer 60 since the start of its use. The information on the use of the toner cartridge 40 includes an ID allocated to the toner cartridge 40 (cartridge ID), the color of a toner filled in the toner cartridge 40, an ID allocated to the color laser printer 60, to which the toner cartridge 40 is attached (printer ID), a cartridge attachment date when the toner cartridge 40 was attached to the color laser printer 60, a cartridge detachment date when the toner cartridge 40 was detached from the color laser printer 60, a number of prints on which images have been printed with the toner cartridge 40 by the color laser printer 60, and a residual quantity of the toner remaining in the toner cartridge 40. The information on the cumulative use of the color laser printer 60 includes a use start date when the use of the color laser printer 60 started, a replacement record of the toner cartridges 40 since the start of the use of the color laser printer 60, a monthly average number of prints since the start of the use of the color laser printer 60, and total consumptions of respective color toners used in the color laser printer 60. Among these pieces of information, the cartridge ID and the toner color of the toner cartridge 40 have been written into the storage element 50 at a factory or another work site at the time of manufacture or recycle of the toner cartridge 40. The other pieces of the information on the toner cartridge 40 and the information on the cumulative use of the color laser printer 60 are written into the storage element 50 by the color laser printer 60, when the toner cartridge 40 is attached to the color laser printer 60 or when the toner cartridge 40 is detached from the color laser printer 60. The pieces of the information on the use of the toner cartridge 40, for example, the number of prints with the toner cartridge 40 and the residual quantity of the toner, are utilized to judge the advisability of recycle of the toner cartridge 40.

Figure 20:
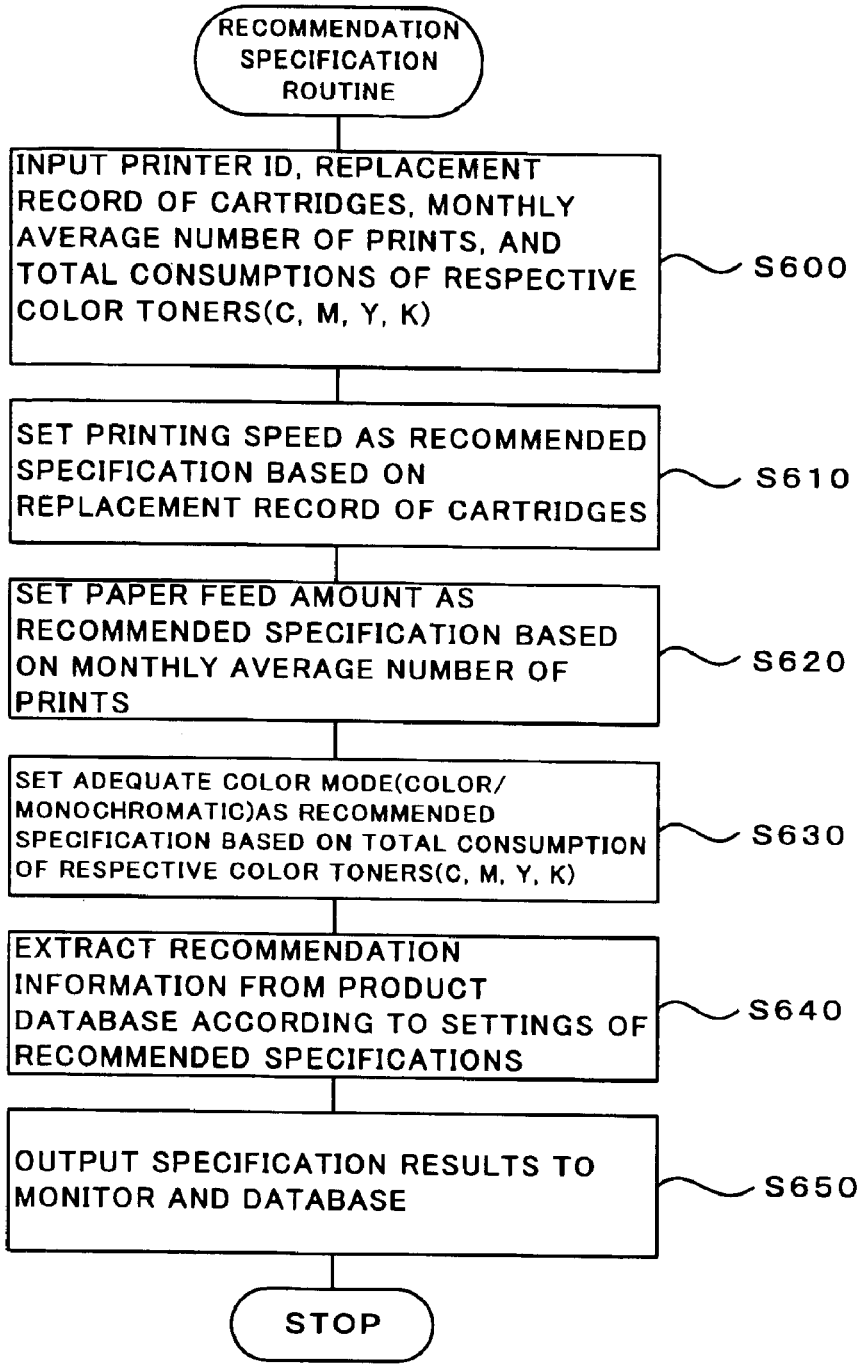
FIG. 20 is a flowchart showing a recommendation specification routine executed by the recommendation specification device 20C.

The recommendation specification device 20C of the embodiment works as discussed below. FIG. 20 is a flowchart showing a recommendation specification routine executed by the recommendation specification device 20C of the embodiment to specify an advisable recommendation for replacement of the color laser printer 60, in response to attachment of the toner cartridge 40 to the cartridge attachment module 28. When the program enters the recommendation specification routine, the recommendation specification device 20C of the embodiment first reads the printer ID and the information on the cumulative use of the color laser printer 60, such as the replacement record of cartridges, the monthly average number of prints, and the total consumptions of the respective color toners (step S600). The operation of reading such information is triggered by a read signal, which is output from the computer assembly 22 to the read/write controller 54 included in the storage element 50 of the toner cartridge 40 attached to the cartridge attachment module 28.

The process then sets a printing speed as one recommended specification, based on the input replacement record of cartridges (step S610). The procedure of setting the printing speed in this embodiment calculates an average use period of one cartridge from the replacement record of cartridges and induces a recommended printing speed from the calculated average use period. A relation between the average use period and the recommended printing speed has been specified experimentally or by another suitable technique and has been stored in advance in the form of a printing speed setting map in the ROM 24. The setting of the printing speed corresponding to the calculated average use period is read from the printing speed setting map. It is generally assumed that the shorter average use period of one cartridge represents a work mode of heavier printing load. The printing speed setting map of the embodiment is thus adjusted to heighten the recommended printing speed with a decrease in average use time of one cartridge. In this embodiment, the calculation of the average use time is based on a recent 6-month replacement record of cartridges.

Namely older information before recent 6 months is thus not taken into account for the calculation.

The process then sets a paper feed amount as another recommended specification, based on the monthly average number of prints read at step S600 (step S620). The procedure of setting the paper feed amount in this embodiment specifies a relation between the monthly average number of prints and the recommended paper feed amount experimentally or by another suitable technique and stores the specified relation in advance in the form of a paper feed amount setting map in the ROM 24. The setting of the paper feed amount corresponding to the input monthly average number of prints is read from the paper feed amount setting map. It is generally assumed that the greater monthly average number of prints represents a work mode of the greater paper consumption. The paper feed amount setting map of the embodiment is thus adjusted to increase the recommended paper feed amount with an increase in monthly average number of prints.

The process subsequently sets an adequate color mode as still another recommended specification, based on the total consumptions of the respective color toners read at step S600 (step S630). The procedure of setting the adequate color mode calculates a use rate of each color toner from the total consumption of the color toner and specifies a monochromatic mode as the adequate color mode when the calculated use rate of a black (K) toner exceeds a preset level (for example, 80%), while specifying a color mode as the adequate color mode when the calculated use rate of a color toner other than the black (K) toner exceeds a predetermined level (for example, 60%). Here the adequate color mode is a specification showing whether each printer is more suitable for color printing or for monochromatic printing. A printer designed to have a greater capacity of a black (K) toner cartridge than the capacities of other color toner cartridges is one example of the printer with the setting of the monochromatic mode as the adequate color mode. In the range where neither the monochromatic mode nor the color mode is specified as the adequate color mode, either of these modes is selectable for the adequate color mode.

Figures 21, 22:
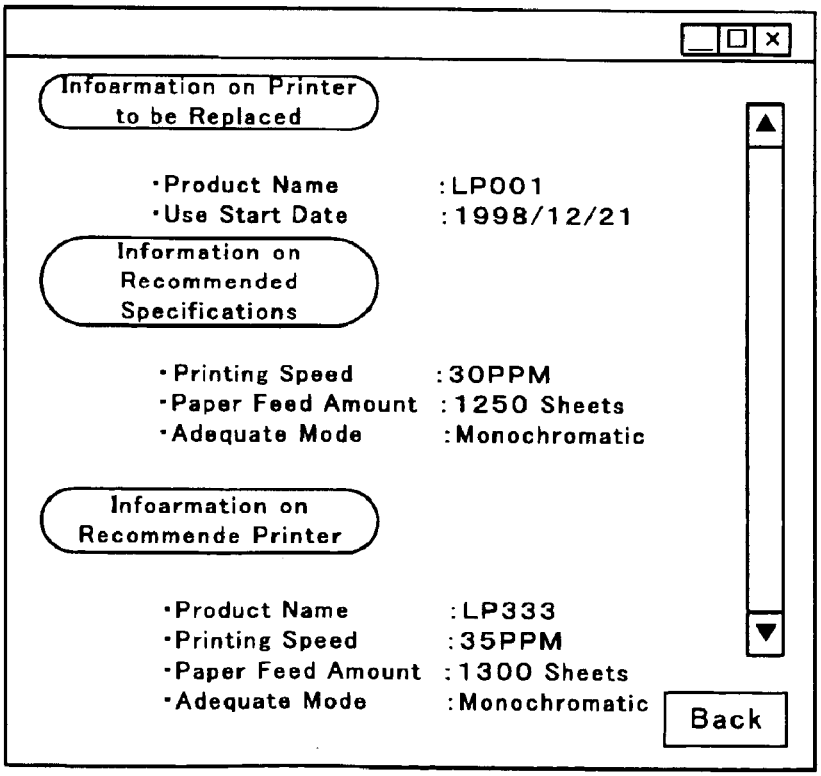
FIG. 21 shows one example of the information stored in the product database.
FIG. 22 shows one example of specification result display window.

The process extracts recommendation information from a product database, based on the settings of the recommended specifications (step S640). FIG. 21 shows one example of the information stored in the product database, which forms part of the database 29. The product database has the storage of information including the product name of each printer, a printing speed of the printer, a paper feed amount expressed by a capacity of a paper tray or a paper cassette, an adequate color mode representing the higher adequacy for color printing or for monochromatic printing, a warm-up time required for a start of the printer, the weight of the printer, and a power consumption of the printer. The procedure of extracting the recommendation information from the product database in this embodiment selects a product proximate to the recommended specifications among products that satisfy all the settings of the recommended specifications and extracts the selected product as an advisable recommendation from the product database. For example, it is assumed that the recommended specifications are the printing speed of 30 PPM (number of prints per minute), the paper feed amount of 1250 sheets, and the monochromatic mode as the adequate color mode. In this case, the procedure selects a product proximate to the recommended specifications among products having the printing speed of not lower than 30 PPM, the paper feed amount of not less than 1250 sheets, and the monochromatic mode as the adequate color mode, and extracts information on the selected product from the product database.

After extraction of the recommendation information from the product database, the settings of the recommended specifications and the extracted recommendation information are output as specification results to the monitor 26 and to the database 29. The program then exits from this recommendation specification routine. FIG. 22 shows one example of specification result display window output to the monitor 26. Information on a printer to be replaced, information on the settings of the recommended specifications, and information on the selected printer as an advisable recommendation are displayed in the specification result display window.

As described above, the recommendation specification device 20C of the embodiment can specify an advisable recommendation for replacement of the color laser printer 60 by simple attachment of the toner cartridge 40, which has been attached to and detached from the color laser printer 60, to the cartridge attachment module 28. The arrangement of the embodiment ensures adequate specification of the advisable recommendation, based on the information on the actual use of the color laser printer 60.

In the recommendation specification device 20C of the embodiment, the replacement record of cartridges, the monthly average number of prints, and the total consumptions of the respective color toners are used as the information on the cumulative use of the color laser printer 60. These pieces of information are not restrictive at all and may be replaced by any other pieces of information usable to specify an advisable recommendation for replacement of the color laser printer 60, for example, an incidence of paper jam, a use rate of a high quality mode, and a use rate of a high speed mode. The recommendation specification device 20C of the embodiment uses the recent 6-month record out of the input replacement record of cartridges to set the recommended specification. The recent 6-month record may be replaced by a record of a preset recent time period, for example, a recent 3-month record or a recent 12-month record. Such time-based selection of information in a preset recent time period is not restricted to the replacement record of cartridges, but is applicable to the other pieces of the information on the cumulative use of the color laser printer 60, that is, the monthly average number of prints and the total consumptions of the respective color toners.

The recommendation specification device 20C of the embodiment sets the printing speed, the paper feed amount, and the adequate color mode as the recommended specifications, based on the input information on the cumulative use of the color laser printer 60. These settings are not restrictive at all, but a resolution, a capacity of an internal RAM, a paper delivery volume, and other factors may be set as recommended specifications. Another possible modification may not set any recommended specifications but may directly specify an advisable recommendation based on the information on the cumulative use of the color laser printer 60. This modified procedure stores in advance a relation between the advisable recommendation and the information on the cumulative use of the color laser printer 60, such as the average use period of one cartridge and the monthly average number of prints, in the form of a recommendation setting map in the ROM 24 or in the database 29. Information on an advisable recommendation corresponding to the input information on the cumulative use of the color laser printer 60 is read from the recommendation setting map.

Figure 23:
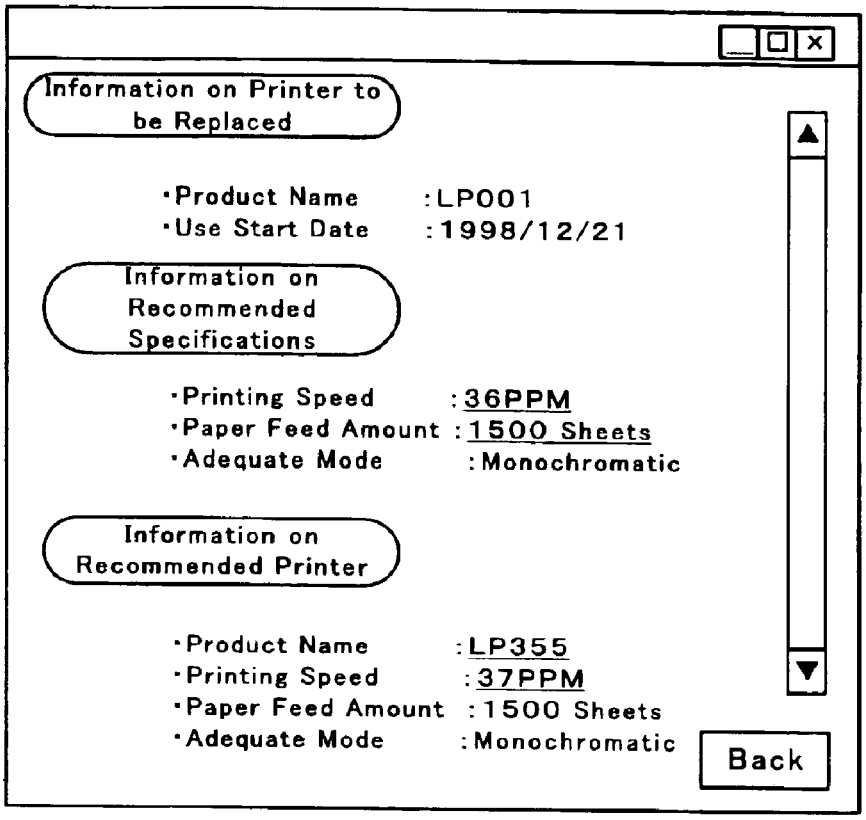
FIG. 23 shows another modified example of specification result display window.

The recommendation specification device 20C of the embodiment sets the recommended specifications based on the information on the cumulative use of the color laser printer 60 at the time of detachment of the toner cartridge 40 from the color laser printer 60. The recommended specifications may be set after elapse of a preset time period since detachment of the toner cartridge 40. One applicable procedure may use values obtained by multiplying the settings of the respective recommended specifications by a preset coefficient (for example, 1.2) as recommended specifications after elapse of the preset time period. One example of such settings is shown in the specification result display window of FIG. 23. Compared with the specification result display window of FIG. 22, the printing speed and the paper feed amount set as the recommended specifications in the specification result display window of FIG. 23 are 1.2 times of the recommended specifications set based on the information on the cumulative use of the color laser printer 60. An advisable recommendation is selected among products satisfying the 1.2-fold recommended specifications. This arrangement enables an advisable recommendation to be specified at a future replacement timing of the color laser printer 60. Another possible modification may calculate a variation per unit time based on the information on the cumulative use of the color laser printer 60, estimate cumulative use information after elapse of a certain time period based on the calculated variation, and set the recommended specifications.

The recommendation specification device 20C of the embodiment selects a product proximate to the recommended specifications as an advisable recommendation among products satisfying all the settings of the recommended specifications. In the absence of any products satisfying all the settings of the recommended specifications, selection may be a product that does not satisfy but is closest to the recommended specifications. In such cases, the advisable recommendation may be selected according to priorities assigned to the respective recommended specifications. One exemplified procedure preferentially selects a product satisfying the recommended specification of the printing speed as the advisable recommendation. The selected advisable recommendation is not restricted to one but may be plurality according to predetermined conditions. The selection of the advisable recommendation is not restricted to the technique of the embodiment, but any other suitable method is applicable to specify the advisable recommendation based on the settings of the respective recommended specifications.

The recommendation specification device 20C of the embodiment specifies an advisable recommendation for replacement of the color laser printer 60, which is constructed as a full-color electrophotographic image formation apparatus adopting the single photoreceptor system and the intermediate transfer system. In this structure of the embodiment, the toner cartridge 40 has the storage element 50 to store the information on the use of the color laser printer 60. The technique of the invention is also applicable to specify an advisable recommendation for replacement of any other color laser printers and photocopiers constructed as full-color electrophotographic image formation apparatuses adopting a multi-photoreceptor system and a direct transfer system and laser printers and photocopiers constructed as monochrome electrophotographic image formation apparatuses.

The embodiment regards the recommendation specification device 20C that specifies an advisable recommendation for replacement of the color laser printer 60, which writes the use-related information into the storage element 50 of the toner cartridge 40 detachably attached to the color laser printer 60. Other applications of the invention include a corresponding method of specifying an advisable recommendation for replacement of the color laser printer 60, a program that causes the computer assembly 22 connecting with the cartridge attachment module 28 to function as the recommendation specification device 20C of the embodiment, and a program that causes the computer assembly 22 to execute the corresponding method of specifying an advisable recommendation for replacement of the color laser printer 60. In the applications of the programs, the respective steps of the recommendation specification routine shown in FIG. 20 are programmed in an adequate programming language.

What is claimed is:

1. A replacement verification method for an image formation apparatus, said replacement verification method verifying requirement for replacement of an image formation apparatus, which is used with a toner cartridge that is attached thereto and has a storage element, said replacement verification method comprising the steps of:

(a) storing apparatus use-related information into said storage element of said toner cartridge attached to said image formation apparatus, where the apparatus use-related information includes a cumulative value regarding use of said image formation apparatus;

(b) acquiring the apparatus use-related information from said storage element; and (c) verifying requirement for replacement of said image formation apparatus, when the cumulative value included in the acquired apparatus use-related information is not less than a preset value.

2. A replacement verification method in accordance with claim 1, wherein the cumulative value represents at least one of a cumulative number of toner cartridges, which have been attached to said image formation apparatus for use, a cumulative consumption of toners, which have been consumed in said image formation apparatus, and a cumulative number of image-forming prints, which have been printed by said image formation apparatus.

3. A replacement verification method in accordance with claim 1, wherein said step (a) stores the apparatus use-related information, which includes a use start time of said image formation apparatus, in addition to the cumulative value, said replacement verification method further comprising the step of:

(d) estimating a timing when the cumulative value reaches the preset value as a replacement timing of said image formation apparatus, based on the acquired apparatus use-related information, in the case of verification of no requirement for replacement of said image formation apparatus at said step (c).

4. A replacement verification method in accordance with claim 1, wherein said step (a) stores at least one of a working environmental temperature and a working environmental humidity of said image formation apparatus as working environment information, in addition to the apparatus use-related information, and said step (c) modifies the preset value based on the working environment information to verify the requirement for replacement of said image formation apparatus.

5. A replacement verification method in accordance with claim 1, wherein said step (a) is executed by said image formation apparatus at a time of attachment of said toner cartridge to said image formation apparatus.

6. A replacement verification method in accordance with claim 1, wherein said step (a) is executed by said image formation apparatus at a time of detachment of said toner cartridge from said image formation apparatus.

7. A storage medium that stores a program therein, said program comprising:

(a) a module that acquires apparatus use-related information from a storage element of a toner cartridge, where the apparatus use-related information includes a cumulative value regarding use of said image formation apparatus, to which said toner cartridge had been attached; and (b) a module that verifies requirement for replacement of said image formation apparatus, when the cumulative value included in the acquired apparatus use-related information is not less than a preset value.

8. A replacement timing estimation method for an image formation apparatus, said replacement timing estimation method estimating a replacement timing of said image formation apparatus, which is used with a toner cartridge that is attached thereto and has a storage element, said replacement timing estimation method comprising the steps of:

(a) storing apparatus use-related information into said storage element of said toner cartridge attached to said image formation apparatus, where the apparatus use-related information includes a cumulative value regarding use of said image formation apparatus and a use start date of said image formation apparatus;

(b) acquiring the apparatus use-related information from said storage element; and (c) estimating a timing when the cumulative value reaches a preset value as the replacement timing of said image formation apparatus, based on the acquired apparatus use-related information.

9. A replacement timing estimation method in accordance with claim 8, wherein the cumulative value represents at least one of a cumulative number of toner cartridges, which have been attached to said image formation apparatus for use, a cumulative consumption of toners, which have been consumed in said image formation apparatus, and a cumulative number of image-forming prints, which have been printed by said image formation apparatus.

10. A replacement timing estimation method in accordance with claim 8, said replacement timing estimation method further comprising the step of:

mapping apparatus identification information for identifying said image formation apparatus to customer information on a customer who owns said image formation apparatus and storing the mapped information, prior to said step (a);

wherein said step (a) stores the apparatus identification information for identifying said image formation apparatus into said storage element, in addition to the apparatus use-related information, said step (b) acquires the apparatus identification information as well as the apparatus use-related information from said storage element and stores the acquired apparatus use-related information in relation to the customer information mapped to the acquired apparatus identification information, and said step (c) stores the estimated replacement timing in relation to the apparatus identification information, after estimation of the replacement timing, said replacement timing estimation method further comprising the steps of:

(d) when an extraction time period is set as an extraction condition, extracting the customer information and the apparatus identification information having the estimated replacement timing, which is stored in relation to the apparatus identification information, within the setting of the extraction time period; and (e) outputting information on said image formation apparatus, which is related to the extracted apparatus identification information, and the extracted customer information.

11. A replacement timing estimation method in accordance with claim 8, wherein said step (a) stores at least one of a working environmental temperature and a working environmental humidity of said image formation apparatus as working environment information, in addition to the apparatus use-related information, and said step (c) modifies the preset value based on the working environment information to estimate the replacement timing of said image formation apparatus.

12. A replacement timing estimation method in accordance with claim 8, wherein said step (a) is executed by said image formation apparatus at a time of attachment of said toner cartridge to said image formation apparatus.

13. A replacement timing estimation method in accordance with claim 8, wherein said step (a) is executed by said image formation apparatus at a time of detachment of said toner cartridge from said image formation apparatus.

14. A storage medium that stores a program therein, said program comprising:

(a) a module that acquires apparatus use-related information from a storage element of a toner cartridge, where the apparatus use-related information includes a cumulative value regarding use of said image formation apparatus and a use start date of said image formation apparatus, to which said toner cartridge had been attached; and (b) a module that estimate a timing when the cumulative value reaches a preset value as the replacement timing of said image formation apparatus, based on the acquired apparatus use-related information.

15. A replacement verification device that verifies requirement for replacement of an image formation apparatus with a toner cartridge attached thereto, based on apparatus use-related information written in a storage element of said toner cartridge by said image formation apparatus, said replacement verification device comprising:

an information acquisition module that acquires a cumulative value regarding use of said image formation apparatus as the apparatus use-related information from said storage element; and a replacement verification module that verifies requirement for replacement of said image formation apparatus, when the acquired cumulative value is not less than a preset value.

16. A replacement verification method for an image formation apparatus, said replacement verification method verifying requirement for replacement of an image formation apparatus, which is used with a toner cartridge that is attached thereto and has a storage element, said replacement verification method comprising the steps of:

(a) storing use-related information regarding use of said image formation apparatus into said storage element of said toner cartridge attached to said image formation apparatus;

(b) acquiring the use-related information from said storage element; and (c) verifying requirement for replacement of said image formation apparatus, based on the acquired use-related information.

17. A replacement timing estimation method for an image formation apparatus, said replacement timing estimation method estimating a replacement timing of said image formation apparatus, which is used with a toner cartridge that is attached thereto and has a storage element, said replacement timing estimation method comprising the steps of:

(a) storing use-related information regarding use of said image formation apparatus into said storage element of said toner cartridge attached to said image formation apparatus;

(b) acquiring the use-related information from said storage element; and (c) estimating the replacement timing of said image formation apparatus, based on the acquired use-related information.

18. A toner cartridge attached to an image formation apparatus, said toner cartridge comprising:

a storage element that stores at least one cumulative value among a cumulative number of toner cartridges, which have been attached to said image formation apparatus for use, a cumulative consumption of toners, which have been consumed in said image formation apparatus, and a cumulative number of image-forming prints, which have been printed by said image formation apparatus, as one piece of writing information by said image formation apparatus, wherein said storage element further stores at least one of a working environmental temperature and a working environmental humidity of said image formation apparatus as another piece of the writing information.

19. A toner cartridge attached to an image formation apparatus, said toner cartridge comprising:

a storage element that stores at least one cumulative value among a cumulative number of toner cartridges, which have been attached to said image formation apparatus for use, a cumulative consumption of toners, which have been consumed in said image formation apparatus, and a cumulative number of image-forming prints, which have been printed by said image formation apparatus, as one piece of writing information by said image formation apparatus, wherein the writing information is written by said image formation apparatus at a time of detachment of said toner cartridge from said image formation apparatus.

20. A component replacement verification method that verifies requirement for replacement of at least one component in an image formation apparatus, which is used with a toner cartridge that is attached thereto and has a storage element, said component replacement verification method comprising the steps of:

(a) storing component use-related information regarding use of said at least one component into said storage element of said toner cartridge attached to said image formation apparatus;

(b) acquiring the component use-related information from said storage element; and (c) verifying requirement for replacement of said at least one component, based on the acquired component use-related information.

21. A component replacement verification method in accordance with claim 20, wherein said step (a) stores information including apparatus use-related information, which regards use of said image formation apparatus since attachment of said at least one component to said image formation apparatus, as the component use-related information.

22. A component replacement verification method in accordance with claim 21, wherein said step (a) stores at least one cumulative value among a cumulative number of toner cartridges, which have been attached to said image formation apparatus for use since attachment of said at least one component to said image formation apparatus, a cumulative consumption of toners, which have been consumed in said image formation apparatus, and a cumulative number of image-forming prints, which have been printed by said image formation apparatus, as the apparatus use-related information, and said step (c) verifies requirement for replacement of said at least one component, when the cumulative value is not less than a preset value.

23. A component replacement verification method in accordance with claim 22, wherein said step (a) stores at least one piece of working environmental information out of a working environmental temperature and a working environmental humidity of said image formation apparatus since attachment of said at least one component to said image formation apparatus, as the apparatus use-related information, and said step (c) modifies the preset value based on the at least one piece of working environmental information to verify requirement for replacement of said at least one component.

24. A component replacement verification method in accordance with claim 22, wherein said step (a) stores the component use-related information, which includes a use start time of said at least one component, in addition to the cumulative value, said component replacement verification method further comprising the step of:

(d) estimating a timing when the cumulative value reaches the preset value as a replacement timing of said at least one component, based on the acquired apparatus use-related information, in the case of verification of no requirement for replacement of said at least one component at said step (c).

25. A component replacement verification method in accordance with claim 20, wherein said at least one component comprises at last one of a photoreceptor, a charge unit, an exposure unit, a cleaning unit, a transfer unit, a fixation unit, and a paper feed unit.

26. A component replacement verification method in accordance with claim 20, wherein said step (a) is executed by said image formation apparatus at a time of attachment of said toner cartridge to said image formation apparatus.

27. A component replacement verification method in accordance with claim 20, wherein said step (a) is executed by said image formation apparatus at a time of detachment of said toner cartridge from said image formation apparatus.

28. A storage medium that stores a program therein, said program comprising:

(a) a module that acquires component use-related information, which regards use of a component included in an image formation apparatus with a toner cartridge attached thereto, from a storage element of said toner cartridge; and (b) a module that verifies requirement for replacement of said component, based on the acquired component use-related information.

29. A component replacement timing estimation method that estimates a replacement timing of a component included in an image formation apparatus with a toner cartridge that is attached thereto and has a storage element, said component replacement timing estimation method comprising the steps of:

(a) storing component use-related information regarding use of said component into said storage element of said toner cartridge attached to said image formation apparatus;

(b) acquiring the component use-related information from said storage element; and (c) estimating the replacement timing of said component, based on the acquired component use-related information.

30. A component replacement timing estimation method in accordance with claim 29, wherein said step (a) stores information including apparatus use-related information regarding use of said image formation apparatus since attachment of said component to said image formation apparatus and a use start time of said component, as the component use-related information.

31. A component replacement timing estimation method in accordance with claim 30, said component replacement timing estimation method further comprising the step of:

mapping apparatus identification information for identifying said image formation apparatus to administrator information on an administrator of said image formation apparatus and storing the mapped information, prior to said step (a);

wherein said step (a) stores the apparatus identification information for identifying said image formation apparatus into said storage element, in addition to the component use-related information, said step (b) acquires the apparatus identification information as well as the component use-related information from said storage element and stores the acquired component use-related information in relation to the administrator information mapped to the acquired apparatus identification information, and said step (c) stores the estimated replacement timing in relation to the apparatus identification information, after estimation of the replacement timing, said component replacement timing estimation method further comprising the steps of:

(d) when an extraction time period is set as an extraction condition, extracting the administrator information and the apparatus identification information having the estimated replacement timing, which is stored in relation to the apparatus identification information, within the setting of the extraction time period; and (e) outputting information on said component, which is related to the extracted apparatus identification information, and the extracted administrator information.

32. A component replacement timing estimation method in accordance with claim 30, wherein said step (a) stores at least one cumulative value among a cumulative number of toner cartridges, which have been attached to said image formation apparatus for use since attachment of said component to said image formation apparatus, a cumulative consumption of toners, which have been consumed in said image formation apparatus, and a cumulative number of image-forming prints, which have been printed by said image formation apparatus, as the apparatus use-related information, and said step (c) estimates a timing when the cumulative value reaches the preset value as a replacement timing of said component.

33. A component replacement timing estimation method in accordance with claim 32, wherein said step (a) stores at least one of a working environmental temperature and a working environmental humidity of said image formation apparatus as working environmental information, in addition to the component use-related information, and said step (c) modifies the preset value based on the working environmental information to estimate the replacement timing of said component.

34. A component replacement timing estimation method in accordance with claim 29, wherein said component comprises at last one of a photoreceptor, a charge unit, an exposure unit, a cleaning unit, a transfer unit, a fixation unit, and a paper feed unit.

35. A component replacement timing estimation method in accordance with claim 29, wherein said step (a) is executed by said image formation apparatus at a time of attachment of said toner cartridge to said image formation apparatus.

36. A component replacement timing estimation method in accordance with claim 29, wherein said step (a) is executed by said image formation apparatus at a time of detachment of said toner cartridge from said image formation apparatus.

37. A storage medium that stores a program therein, said program comprising:

(a) a module that acquires component use-related information, which regards use of a component included in an image formation apparatus with a toner cartridge attached thereto, from a storage element of said toner cartridge; and (b) a module that verifies requirement for replacement of said component, based on the acquired component use-related information.

38. A component replacement verification device that verifies requirement for replacement of at least one component included in an image formation apparatus, which is used with a toner cartridge that is attached thereto and has a storage element, said component replacement verification device comprising:

an information acquisition module that acquires component use-related information regarding use of said at least one component from said storage element of said toner cartridge attached to said image formation apparatus; and a replacement verification module that verifies requirement for replacement of said at least one component, based on the acquired component use-related information.

39. A component replacement verification device in accordance with claim 38, wherein the component use-related information includes apparatus use-related information regarding use of said image formation apparatus since attachment of said at least one component to said image formation apparatus.

40. A recommendation specification method that specifies an advisable recommendation for replacement of an image formation apparatus, said recommendation specification method comprising the steps of:

(a) storing information on multiple image formation apparatuses having different performances as apparatus information;

(b) storing information, which includes use-related information regarding use of said image formation apparatus, into a storage element of a toner cartridge attached to said image formation apparatus;

(c) acquiring the use-related information from said storage element; and (d) selecting a piece of apparatus information adequate for an installation location of said image formation apparatus out of the stored apparatus information, based on the acquired use-related information, and specifying an advisable image formation apparatus corresponding to the selected piece of apparatus information as the advisable recommendation.

41. A recommendation specification method in accordance with claim 40, wherein said step (d) comprises the sub-steps of:

(d1) setting a recommended performance of said image formation apparatus, based on the acquired use-related information;

(d2) selecting a piece of apparatus information that satisfies the setting of the recommended performance out of the stored apparatus information; and (d3) specifying said advisable image formation apparatus corresponding to the selected piece of apparatus information as the advisable recommendation.

42. A recommendation specification method in accordance with claim 41, wherein said sub-step (d2) selects a piece of apparatus information representing a specific image formation apparatus having either a higher performance or a lower performance proximate to the setting of the recommended performance out of the stored apparatus information.

43. A recommendation specification method in accordance with claim 41, wherein said sub-step (d1) sets a prospective recommended performance of said image formation apparatus after elapse of a predetermined time period since detachment of said toner cartridge from said image formation apparatus.

44. A recommendation specification method in accordance with claim 40, wherein said step (d) selects the piece of apparatus information, based on use-related information for a predetermined time period prior to detachment of said toner cartridge from said image formation apparatus, among the acquired use-related information.

45. A recommendation specification method in accordance with claim 40, wherein the use-related information includes a use period of each toner cartridge, which had been attached to said image formation apparatus, and said step (d) selects a piece of apparatus information representing an image formation apparatus of a higher image formation speed, in response to a shorter use period.

46. A recommendation specification method in accordance with claim 40, wherein the use-related information includes a total consumption of toners, and said step (d) selects a piece of apparatus information representing an image formation apparatus with a larger capacity of a toner cartridge attachable thereto, in response to a greater total consumption of toners.

47. A recommendation specification method in accordance with claim 40, wherein the use-related information includes an average number of image-forming prints per unit time, and said step (d) selects a piece of apparatus information representing an image formation apparatus with a greater volume of a paper cassette mountable thereon, in response to a higher average number of image-forming prints.

48. A storage medium that stores a program therein, said program comprising:

(a) a module that acquires use-related information, which regards use of an image formation apparatus with a toner cartridge attached thereto, from a storage element of said toner cartridge; and (b) a module that selects a piece of apparatus information, which is adequate for an installation location of said image formation apparatus based on the acquired use-related information, from a memory unit that stores information on multiple image formation apparatuses having different performances as apparatus information, and specifies an advisable image formation apparatus corresponding to the selected piece of apparatus information as an advisable recommendation.

49. A recommendation specification device that specifies an advisable recommendation for replacement of an image formation apparatus, said recommendation specification apparatus comprising:

an information memory unit that stores apparatus information on multiple image formation apparatuses having different performances as part of storable information and is capable of storing other information;

a connection module that is electrically connectable with a storage element of a toner cartridge, which is attachable to and detachable from said image formation apparatus;

a use-related information input control module that inputs from said storage element use-related information, which regards use of said image formation apparatus and has been written into said storage element by said image formation apparatus, under an electrical connection with said storage element by means of said connection module, and stores the input use-related information into said information memory unit; and an information selection control module that selects a piece of apparatus information adequate for an installation location of said image formation apparatus out of the apparatus information stored in said information memory unit, based on the use-related information stored in said information memory unit, and outputs the selected piece of apparatus information as information on the advisable recommendation.

* * * * *